US008994616B2

(12) United States Patent
Umetsu et al.

(10) Patent No.: US 8,994,616 B2
(45) Date of Patent: Mar. 31, 2015

(54) MULTIPLE ANODE MATRIX VACUUM FLUORESCENT DISPLAY, AND DRIVING CIRCUIT AND DRIVING METHOD THEREOF

(75) Inventors: Tadayoshi Umetsu, Mobara (JP); Toshihiro Nishioka, Mobara (JP); Takashi Muguruma, Mobara (JP); Katsumi Takayama, Mobara (JP)

(73) Assignee: Futaba Corporation, Mobara-Shi, Chiba-Ken (JP)

( * ) Notice: Subject to any disclaimer, the term of this patent is extended or adjusted under 35 U.S.C. 154(b) by 403 days.

(21) Appl. No.: 13/430,903

(22) Filed: Mar. 27, 2012

(65) Prior Publication Data

US 2012/0249494 A1 Oct. 4, 2012

(30) Foreign Application Priority Data

Mar. 29, 2011 (JP) ..... 2011-072871

(51) Int. Cl.
*G09G 3/20* (2006.01)
*G09G 3/22* (2006.01)
*H01J 31/12* (2006.01)

(52) U.S. Cl.
CPC ..... *H01J 31/127* (2013.01); *G09G 3/22* (2013.01)
USPC ..... 345/75.1

(58) Field of Classification Search
CPC ..... G09G 3/022
USPC ..... 345/47, 75.1
See application file for complete search history.

(56) References Cited

U.S. PATENT DOCUMENTS

2003/0193455 A1* 10/2003 Mizohata et al. ..... 345/75.1
2005/0140594 A1* 6/2005 Ishikawa ..... 345/75.1

* cited by examiner

*Primary Examiner* — Jimmy H Nguyen
*Assistant Examiner* — Hang Lin
(74) *Attorney, Agent, or Firm* — Bacon & Thomas, PLLC

(57) ABSTRACT

In a Q-tuple anode matrix vacuum fluorescent display (VFD), a plurality of selected pixels are turned on one by one to sequentially emit lights in accordance with a display signal. Each selected pixel is selected from Q anode segments to be turned on to emit lights by turning on a first and a second grid electrode positioned adjacent to each other. Each selected pixel is formed of Q/2 anode segments in total including R anode segments sequentially disposed from a position closest to the first grid electrode and facing the second grid electrode and (Q/2−R) anode segments sequentially disposed from a position closest to the second grid electrode and facing the first grid electrode, R being an integer ranging from 1 to (Q/2−1).

13 Claims, 15 Drawing Sheets

MULTIPLE ANODE MATRIX VACUUM FLUORESCENT DISPLAY, AND DRIVING CIRCUIT AND DRIVING METHOD THEREOF

FIELD OF THE INVENTION

The present invention relates to a vacuum fluorescent display, and a driving circuit and a driving method thereof.

BACKGROUND OF THE INVENTION

As for a technique related to a vacuum fluorescent display (VFD), a VFD properly operated by a multiple matrix driving method, a multiple matrix driving method for the VFD, and a chip in glass (CIG) VFD in which a driving circuit is mounted have been known in the prior art (see, e.g., Japanese Patent Application Publication Nos. 2000-306532 and 2003-228334, and "Vacuum Fluorescent Display (p. 170-183 and p. 226-248)" Takao Kishino published by Sangyo Tosho Publishing Co., Ltd. on Oct. 31, 1990). A conventional multiple matrix driving method improves a duty factor and achieves excellent display quality as well in comparison with a single matrix method.

Although the conventional multiple matrix driving method may realize high display quality as compared with the single matrix method, there is a strong demand for much higher display quality than by the conventional methods.

SUMMARY OF THE INVENTION

In view of the above, the present invention provides a vacuum fluorescent display, and a driving circuit and a driving method thereof, capable of obtaining more excellent display quality than by a conventional method.

In accordance with a first aspect of the present invention, there is provided an M-tuple anode matrix vacuum fluorescent display (VFD) including a driving circuit; a plurality of rows of anode segments wherein each row of anode segments is divided into groups, each group having M anode segments and M anode inlet lines formed by laterally connecting anode segments located at same relative positions in groups, M being an integer that is represented by $2^K$ and K being an integer that is 3 or greater; and a plurality of columns of grid electrodes extending in a longitude direction perpendicular to the rows of anode segments, each having a grid inlet line, wherein a plurality of rows of anode segments and a plurality of columns of grid electrodes are disposed in a matrix form such that each of the grid electrodes faces M/2 anode segments in each of the rows of anode segments.

The driving circuit turns on a plurality of selected pixels one by one to sequentially emit lights in accordance with a display signal, each selected pixel being formed of M/2 anode segments selected from M anode segments to be turned on to emit lights by turning on a first and a second grid electrode positioned adjacent to each other. Each selected pixel belongs to one of three kinds of selected pixels, including a pixel formed of M/4 anode segments sequentially disposed from a position closest to the first grid electrode and facing the second grid electrode and M/4 anode segments sequentially disposed from a position closest to the second grid electrode and facing the first grid electrode, one or more pixels formed of (M/4−J) anode segments sequentially disposed from a position closest to the first grid electrode and facing the second grid electrode and (M/4+J) anode segments sequentially disposed from a position closest to the second electrode and facing the first grid electrode, J being an integer ranging from 1 to $2^{(k-3)}$, and one or more pixels formed of (M/4+J) anode segments sequentially disposed from a position closest to the first grid electrode and facing the second grid electrode and (M/4−J) anode segments sequentially disposed from a position closest to the second electrode and facing the first grid electrode.

In accordance with a second aspect of the present invention, there is provided a driving circuit of an M-tuple anode matrix vacuum fluorescent display (VFD) which includes a plurality of rows of anode segments wherein each row of anode segments is divided into groups, each group having M anode segments and M anode inlet lines formed by laterally connecting anode segments located at same relative positions in groups, M being an integer that is represented by $2^K$ and K being an integer that is 3 or greater; and a plurality of columns of grid electrodes extending in a longitude direction perpendicular to the row of anode segments, each having a grid inlet line, wherein the rows of anode segments and the columns of grid electrodes are disposed in a matrix form such that each of the grid electrodes faces M/2 anode segments in each of the rows of anode segments.

The driving circuit turns on a plurality of selected pixels one by one to sequentially emit lights in accordance with a display signal, each selected pixel being formed of M/2 anode segments selected from M anode segments to be turned on to emit lights by turning on a first and a second grid electrode positioned adjacent to each other. Each selected pixel belongs to one of three kinds of selected pixels including a pixel formed of M/4 anode segments sequentially disposed from a position closest to the first grid electrode and facing the second grid electrode and M/4 anode segments sequentially disposed from a position closest to the second grid electrode and facing the first grid electrode, one or more pixels formed of (M/4−J) anode segments sequentially disposed from a position closest to the first grid electrode and facing the second grid electrode and (M/4+J) anode segments sequentially disposed from a position closest to the second electrode and facing the first grid electrode, J being an integer ranging from 1 to $2^{(k-3)}$, and one or more pixels formed of (M/4+J) anode segments sequentially disposed from a position closest to the first grid electrode and facing the second grid electrode and (M/4−J) anode segments sequentially disposed from a position closest to the second electrode and facing the first grid electrode.

In accordance with a third aspect of the present invention, there is provided a method of driving an M-tuple anode matrix vacuum fluorescent display (VFD) which includes a plurality of rows of anode segments wherein each row of anode segments is divided into groups, each group having M anode segments and M anode inlet lines formed by laterally connecting anode segments located at same relative positions in groups, M being an integer that is represented by $2^K$ and K being an integer that is 3 or greater; and a plurality of columns of grid electrodes extending in a longitude direction perpendicular to the rows of anode segments, each having a grid inlet line, wherein the rows of anode segments and the columns of grid electrodes are disposed in a matrix form such that each of the grid electrodes faces M/2 anode segments in each of the rows of anode segments.

The method includes turning on a plurality of selected pixels one by one to sequentially emit lights in accordance with a display signal, each selected pixel being formed of M/2 anode segments selected from M anode segments to be turned on to emit lights by turning on a first and a second grid electrode positioned adjacent to each other. Each selected pixel belongs to one of three kinds of selected pixels including a pixel formed of M/4 anode segments sequentially disposed from a position closest to the first grid electrode and facing the second grid electrode and M/4 anode segments sequentially disposed from a position closest to the second grid electrode and facing the first grid electrode, one or more pixels formed of (M/4−J) anode segments sequentially disposed from a position closest to the first grid electrode and facing the second grid electrode and (M/4+J) anode segments sequentially disposed from a position closest to the second electrode and facing the first grid electrode, J being an integer ranging from 1 to $2^{(k-3)}$, and one or more pixels formed of (M/4+J) anode segments sequentially disposed from a position closest to the first grid electrode and facing the second grid electrode and (M/4−J) anode segments sequentially disposed from a position closest to the second electrode and facing the first grid electrode.

In accordance with a fourth aspect of the present invention, there is provided a Q-tuple anode matrix vacuum fluorescent display (VFD) including a driving circuit; a plurality of rows of anode segments wherein each row of anode segments is divided into groups, each group having Q anode segments and Q anode inlet lines formed by laterally connecting anode segments located at same relative positions in groups, Q being an even number that is 8 or greater; and a plurality of columns of grid electrodes extending in a longitude direction perpendicular to the rows of anode segments, each having a grid inlet line, wherein the rows of anode segments and the columns of grid electrodes are disposed in a matrix form such that each of the grid electrodes faces Q/2 anode segments in each of the rows of anode segments.

The driving circuit turns on a plurality of selected pixels one by one to sequentially emit lights in accordance with a display signal, each selected pixel being formed of Q/2 anode segments selected from Q anode segments to be turned on to emit lights by turning on a first and a second grid electrode positioned adjacent to each other. The Q/2 anode segments includes R anode segments sequentially disposed from a position closest to the first grid electrode and facing the second grid electrode and (Q/2−R) anode segments sequentially disposed from a position closest to the second grid electrode and facing the first grid electrode, R being an integer ranging from 1 to (Q/2−1).

In accordance with a fifth aspect of the present invention, there is provided a driving circuit of a Q-tuple anode matrix vacuum fluorescent display (VFD) which includes a plurality of rows of anode segments wherein each row of anode segments is divided into groups, each group having Q anode segments and Q anode inlet lines formed by laterally connecting anode segments located at same relative positions in groups, Q being an even number that is 8 or greater; and a plurality of columns of grid electrodes extending in a longitude direction perpendicular to the rows of anode segments, each having a grid inlet line, wherein the rows of anode segments and the columns of grid electrodes are disposed in a matrix form such that each of the grid electrodes faces Q/2 anode segments in each of the rows of anode segments.

The driving circuit turns on a plurality of selected pixels one by one to sequentially emit lights in accordance with a display signal, each selected pixel being formed of Q/2 anode segments selected from Q anode segments to be turned on to emit lights by turning on a first and a second grid electrode positioned adjacent to each other. The Q/2 anode segments includes R anode segments sequentially disposed from a position closest to the first grid electrode and facing the second grid electrode and (Q/2−R) anode segments sequentially disposed from a position closest to the second grid electrode and facing the first grid electrode, R being an integer ranging from 1 to (Q/2−1). In accordance with a sixth aspect of the present invention, there is provided a driving circuit of a Q-tuple anode matrix vacuum fluorescent display (VFD) which includes a plurality of rows of anode segments wherein each row of anode segments is divided into groups, each group having Q anode segments and Q anode inlet lines formed by laterally connecting anode segments located at same relative positions in groups, Q being an even number that is 8 or greater; and a plurality of columns of grid electrodes extending in a longitude direction perpendicular to the rows of anode segments, each having a grid inlet line, wherein the rows of anode segments and the columns of grid electrodes are disposed in a matrix form such that each of the grid electrodes faces Q/2 anode segments in each of the rows of anode segments, wherein the driving circuit turns on a plurality of selected pixels one by one to sequentially emit lights in accordance with a display signal, each selected pixel being formed of Q/2 anode segments selected from Q anode segments to be turned on to emit lights by turning on a first and a second grid electrode positioned adjacent to each other, and wherein the Q/2 anode segments includes R anode segments sequentially disposed from a position closest to the first grid electrode and facing the second grid electrode and (Q/2−R) anode segments sequentially disposed from a position closest to the second grid electrode and facing the first grid electrode, R being an integer ranging from 1 to (Q/2−1).

In the VFD in accordance with the aspects of the present invention, a plurality of selected pixels facing two grid electrodes are turned on one by one to sequentially emit lights in accordance with a display signal, thereby reducing appearance of dark lines on opposite end portions of the selected pixels and improving display quality.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Embodiments of the present invention are related to an M-tuple anode matrix vacuum fluorescent display (VFD), and a driving circuit and a driving method thereof. The VFD includes a plurality of rows of anode segments; and a plurality of columns of grid electrodes, the rows of anode segments and the columns of grid electrodes being disposed in a matrix form such that each of the grid electrodes faces M/2 anode segments in each row of anode segments. Each row of anode segments includes anode segments divided into a number of groups, each group having M anode segments and M anode inlet lines formed by laterally connecting anode segments located at same relative positions in groups, wherein M is an integer that is represented by $2^K$, K being an integer that is 3 or greater. The grid electrodes extend in a longitudinal direction perpendicular to the rows of anode segments and include grid inlet lines.

In accordance with embodiments of the present invention, plural elected pixels are turned on one by one to sequentially emit lights in accordance with a display signal, each selected pixel being formed of M/2 anode segments selected from the M anode segments to be turned on to emit lights by turning on a first and a second grid electrode positioned adjacent to each other. The selected pixels include a first chosen pixel, one or more second chosen pixels, and one or more third chosen pixels. The first chosen pixel is formed of M/4 anode segments sequentially disposed from a position closest to the first grid electrode and facing the second grid electrode and M/4 anode segments sequentially disposed from a position closest to the second grid electrode and facing the first grid electrode.

Each of the second chosen pixels is formed of (M/4−J) anode segments sequentially disposed from a position closest to the first grid electrode and facing the second grid electrode and (M/4+J) anode segments sequentially disposed from a position closest to the second electrode and facing the first grid electrode, J being an integer ranging from 1 to $2^{(k-3)}$. Each of the third chosen pixels is formed of (M/4+J) anode segments sequentially disposed from a position closest to the first grid electrode and facing the second grid electrode and (M/4−J) anode segments sequentially disposed from a position closest to the second electrode and facing the first grid electrode.

Hereinafter, an 8-tuple anode matrix VFD, and a driving circuit and method thereof in accordance with a first embodiment of the present invention will be described with reference to FIGS. 1 to 12 and 14 which form a part hereof.

Figure 1:
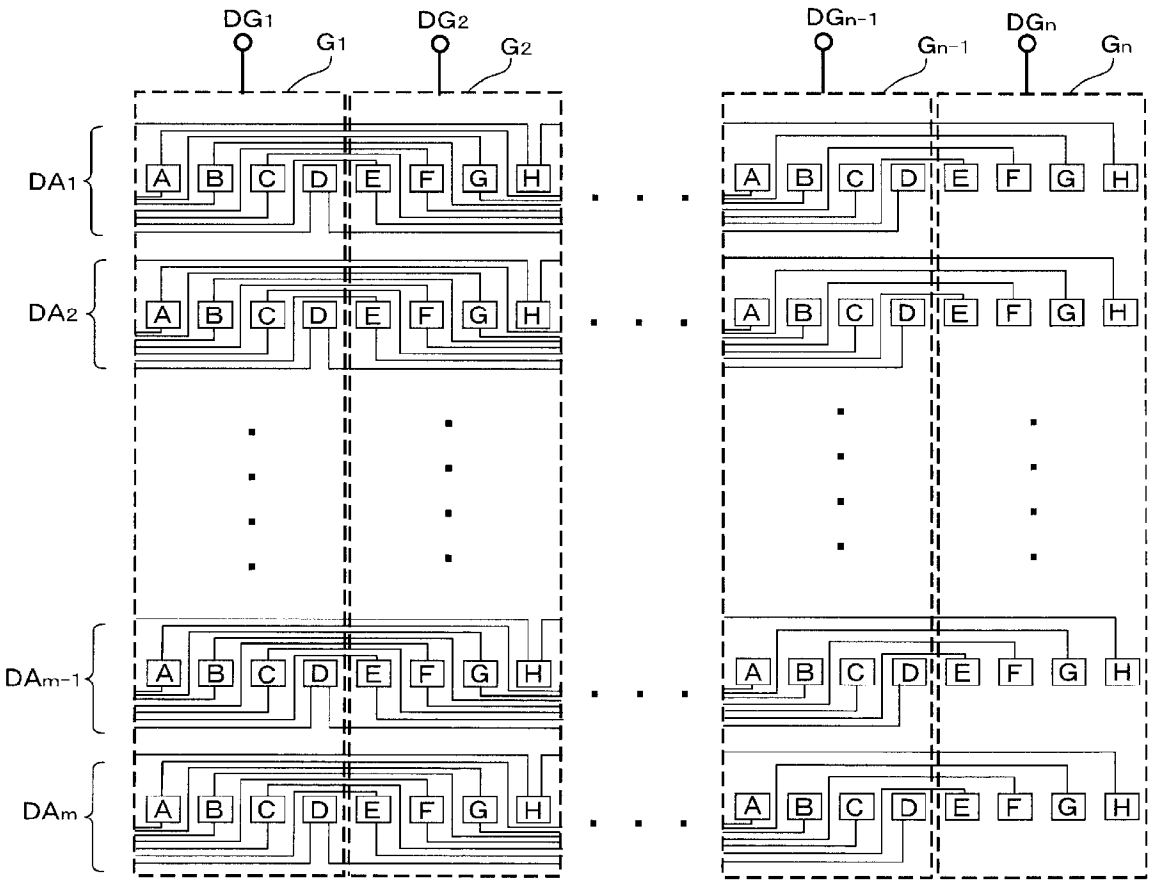
FIG. 1 is a conceptual view showing a structure of electrodes, viewed from a display surface of an 8-tuple anode matrix vacuum fluorescent display (VFD) in accordance with a first embodiment of the present invention.

FIG. 1 is a conceptual view showing a structure of electrodes, viewed from a display surface of 8-tuple the 8-tuple anode matrix VFD in accordance with the first embodiment of the present invention. In FIG. 1, vertical lines in the longitudinal direction are defined as columns, and horizontal lines in the lateral direction are defined as rows.

A grid electrode $G_1$ extends in the longitudinal direction so as to face anode segments A, B, C and D in a first row; anode segments A, B, C and D in a second row; . . . ; anode segments A, B, C and D in an $(m-1)^{th}$ row; and anode segments A, B, C and D in an $m^{th}$ row. A grid electrode $G_2$ extends in the longitudinal direction so as to face anode segments E, F, G and H in the first row; anode segments E, F, G and H in the second row; . . . ; anode segments E, F, G and H in the $(m-1)^{th}$ row; anode segments E, F, G and H in the in the $m^{th}$ row. Likewise, a grid electrode $G_3$ (not shown in FIG. 1) to a grid electrode $G_{n-1}$ and a grid electrode $G_n$ extend in the longitudinal direction.

As described, each of the grid electrodes $G_1$ to $G_n$ extends in the longitude direction, and the direction perpendicular to the longitude direction is defined as the lateral direction. The grid electrodes extending in the longitude direction are sequentially arranged in the lateral direction in order of the grid electrode $G_1$, the grid electrode $G_2$, . . . , the grid electrode $G_{n-1}$, and the grid electrode G.

In an example of FIG. 1, in the 8-tuple anode matrix VFD, m rows of anode segments and n columns of grid electrodes are disposed in a matrix form, wherein each of the grid electrodes is disposed to face four anode segments in each row of anode segments. Further, one row of anode segments includes 4×n anode segments. The grid electrode $G_1$ is connected to a grid inlet line $DG_1$. Likewise, the grid electrode $G_2$ is connected to a grid inlet line $DG_2$, . . . ; and the grid electrode $G_n$ is connected to a grid inlet line $DG_n$. In this manner, n grid electrode inlet lines are drawn out from the respective n grid electrodes.

Groups of eight anode segments including an anode segment A (anode segment indicated by A in a box in FIG. 1) to the anode segment H (anode segment indicated by H in a box in FIG. 1) are repeatedly and sequentially disposed in the lateral direction, facing the grid electrodes.

Anode segments disposed in the same row and represented by the same character to face the respective grid electrodes are connected to each other. For example, an anode segment A in the first row facing the grid electrode $G_1$, an anode segment A in the first row facing the grid electrode $G_3$, . . . , and an anode segment A in the first row facing the grid electrode $G_{n-1}$ are connected to each other. Likewise, as to anode segments B to H, anode segments represented by the same character are connected to each other. That is, the anode segments are divided into groups, each having eight anode segments, in the lateral direction of FIG. 1, wherein the anode segments located at same relative positions in groups are laterally connected to each other, thereby forming a row of the anode segments having eight anode inlet lines.

In this manner, a VFD includes a plurality of anode segments A connected to each other, a plurality of anode segments B connected to each other, a plurality of anode segments C connected to each other, a plurality of anode segments D connected to each other, a plurality of anode segments E connected to each other, a plurality of anode segments F connected to each other, a plurality of anode segments G connected to each other, and a plurality of anode segments H connected to each other in each of the first to $m^{th}$ rows, which is referred to as 8-tuple anode matrix VFD. Generally, a VFD operating in a mode in which anode segments disposed in a line are divided into a number of groups, each having M (integer) anode segments, and the anode segments located at same relative positions in groups are laterally connected to each other is referred to as an M-tuple anode matrix VFD.

Figure 2:
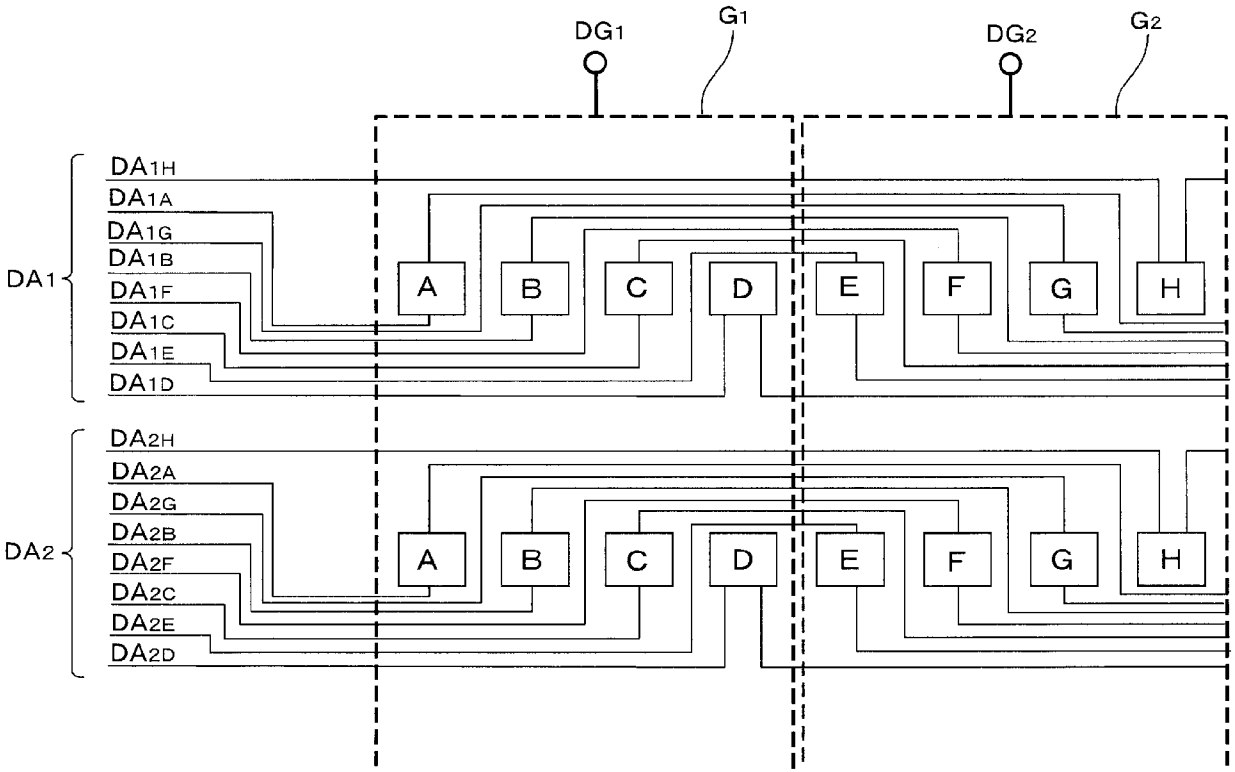
FIG. 2 is an enlarged view of FIG. 1 showing part of inlet lines from anode segments.

FIG. 2 is an enlarged view of FIG. 1 showing some parts of inlet lines from anode segments. Anode inlet lines $DA_1$ are inlet lines from the anode segments in the first row. Anode inlet lines $DA_2$ are inlet lines from the anode segments in the second row. Anode inlet lines $DA_m$ are inlet lines from the anode segments in the $m^{th}$ row.

The anode inlet lines $DA_1$ include an anode inlet line $DA_{1A}$ from anode segments A arranged in the first row; an anode inlet line $DA_{1B}$ from anode segments B (arranged) in the first row; an anode inlet line $DA_{1C}$ from anode segments C (arranged) in the first row; an anode inlet line $DA_{1D}$ from anode segments D (arranged) in the first row; an anode inlet line $DA_{1E}$ from anode segments E (arranged) in the first row; an anode inlet line $DA_{1F}$ from anode segments F (arranged) in the first row; an anode inlet line $DA_{1G}$ from anode segments G (arranged) in the first row; and an anode inlet line $DA_{1H}$ from anode segments H (arranged) in the first row.

Likewise, the anode inlet lines $DA_2$ include anode inlet lines $DA_{2A}$ to $DA_{2H}$ from anode segments arranged in the second row, and the anode inlet lines $DA_m$ include anode inlet lines $DA_{mA}$ to $DA_{mH}$ from anode segments arranged) in the $m^{th}$ row. In this manner, 8×m anode inlet lines are drawn from all of the anode segments in the first to $m^{th}$ rows.

Figure 3:
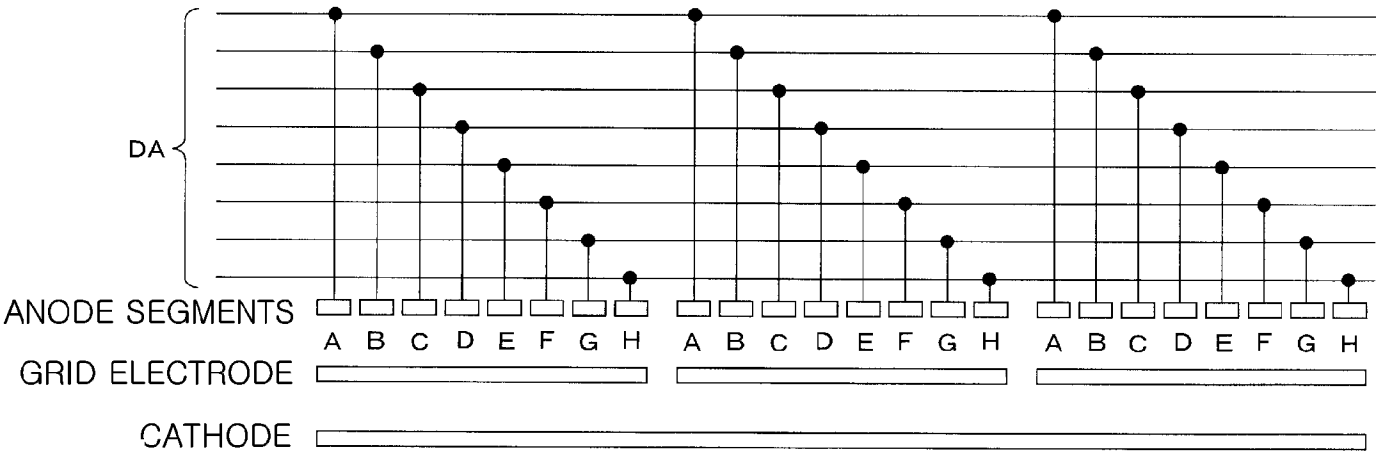
FIG. 3 is a conceptual view showing a cross section of the structure of electrodes perpendicular to the display surface of the 8-tuple anode matrix VFD in accordance with the present embodiment.

FIG. 3 is a conceptual view showing a cross section of the structure of electrodes perpendicular to the display surface of the 8-tuple anode matrix VFD. FIG. 3 shows relationships in arrangement between the anode segments A to H, the grid electrodes and a cathode. The grid electrodes are in a form of a metal mesh and control whether to allow electrons generated in the cathode to pass through the grid electrodes. When a positive voltage is applied to grid electrodes by supplying the positive voltage to a grid inlet line in order to allow electrons to pass through the grid electrodes, it is defined as "the grid inlet line is turned on." On the other hand, when the positive voltage is not applied to the grid electrodes by supplying no positive voltage to a grid inlet line in order to allow electrons not to pass through the grid electrodes, it is defined as "the grid inlet line is turned off.

The anode segments A to H are coated with a fluorescent substance and emit lights by collisions of electrons therewith. Here, anode segments emit lights only when a positive voltage with respect to the cathode applied to the corresponding grid electrodes is high enough to allow electrons pass through the grid electrons and to accelerate electrons to the anode segments facing the grid electrode. That is, the anode segments facing grid electrodes to which the positive voltage is applied (turned on) among the grid electrodes arranged to extend in the longitudinal direction (longitude direction) of FIG. 1, viewed from the display surface of the VFD, are turned on to emit lights. In brief, among eight anode segments capable of emitting lights, only anode segments to which the positive voltages are applied are turned on to practically emit lights.

Figure 4A:
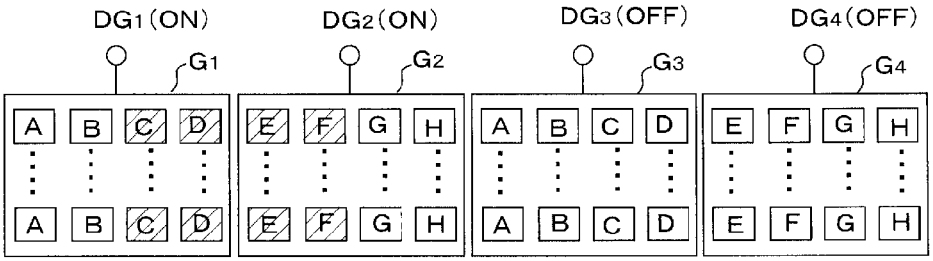
FIGS. 4A to 4C illustrate a display mode of the VFD of FIG. 1.
Figure 4B:
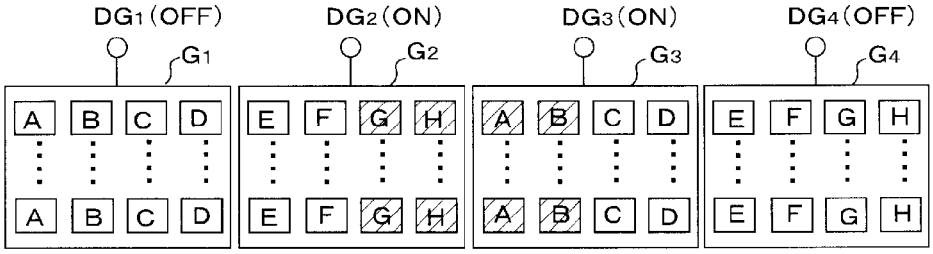
Figure 4C:
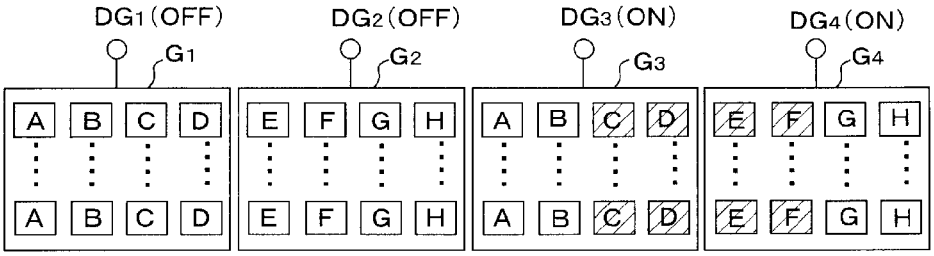

FIGS. 4A to 4C illustrate a display mode of the VFD shown in FIG. 1. In a display operation of the VFD, two neighboring grid electrodes are selected at the same time and a positive voltage is applied to the two grid electrodes. For example, FIG. 4A illustrates that a positive voltage is applied to grid electrodes $G_1$ and $G_2$ so that electrons pass therethrough. FIG. 4B illustrates that a positive voltage is applied to grid electrodes $G_2$ and $G_3$ so that electrons pass therethrough. FIG. 4C illustrates that a positive voltage is applied to grid electrodes $G_3$ and $G_4$ so that electrons pass therethrough.

In a basic mode of emitting lights in accordance with the present embodiment, a positive voltage is applied to two neighboring grid electrodes. Then, among eight anode segments facing the two grid electrodes in each row of anode segments, only portions corresponding to 2×2 (four) anode segments sequentially disposed from a position closest to the other grid electrode, which have the most uniform distribution of electric fixed intensity in a space between the anode segments and the cathode, are turned on to emit lights.

Referring to FIG. 4, a mode of emitting lights is described below in detail with an illustrative example. For example, light emitting portion is shifted from left to right. In order to observe the shifting of the light emitting portion, a shifting speed of the light emitting portion is generally slower than a scanning speed of one frame, which will be described later.

A positive voltage is applied to the grid electrodes $G_1$ and $G_2$, and the positive voltage is applied to anode inlet lines respectively connected to anode segments C, D, E and F so that the corresponding anode segments emit lights (See FIG. 4A). A positive voltage is applied to the grid electrodes $G_2$ and $G_3$, and accordingly the positive voltage is applied to anode inlet lines respectively connected to anode segments G, H, A and B so that the corresponding anode segments emit lights (See FIG. 4B). A positive voltage is applied to the grid electrodes $G_3$ and $G_4$, and accordingly the positive voltage is applied to anode inlet lines respectively connected to anode segments C, D, E and F so that the corresponding anode segments emit lights (See FIG. 4C).

As a result, the shaded anode segments can be made to sequentially emit lights as shown in FIG. 4A to 4C so that the light-emitting portion is observed to be shifted from left to right with the naked eye. Since, however, the scanning speed of a grid electrode is fast, it is difficult to observe an actual shifting of light-emitting portion from FIG. 4A to FIG. 4B in the lateral direction with the naked eye. The example shown in FIGS. 4A to 4C respectively illustrates display patterns in different frames.

In the following description, it is defined as "an anode segment is turned on" when a positive voltage is applied to the anode segment, and as "an anode segment is turned off" when a positive voltage is not applied to the anode segment.

As described above, in controlling the grid electrodes, two neighboring grid electrodes in the lateral direction are sequentially selected to be turned on. For example, the grid electrodes $G_1$ and $G_2$ on the left are selected first, and the selected position of grid electrodes is sequentially moved to the right, and the grid electrodes $G_{n-1}$ and $G_n$ are finally selected. Such a series of processes is referred to as the process of one frame. Further, although the above example describes the case that a light emitting portion is visually moved, a process of one frame in which two grid electrodes are sequentially selected is always performed regardless of how to process anode segments even when a light emitting portion is not visually changed.

In the embodiment described above, two grid electrodes are turned on, and accordingly only particular successive anode segments are turned on to emit lights among the anode segments facing the turned-on grid electrodes. The successive segments that concurrently emit lights are defined as a pixel. That is, the anode segments emit lights on the basis of the pixel. If there is a plurality of kinds of pixels corresponding to the two grid electrodes, one pixel selected from the kinds of pixels is referred to as a selected pixel.

In the 8-tuple anode matrix VFD of the present embodiment, one selected pixel is formed of four anode segments (which are disposed adjacently as shown in FIGS. 4A to 4C) selected from the eight anode segments. Different sets of four neighboring anode segments constitute different pixels. The foregoing selected pixel is the one selected from the pixels formed of the sets of four anode segments at different positions. As will be described in detail later, a multiple anode matrix VFD of the present embodiment selects a particular pixel in accordance with a display signal (see FIG. 9) while controlling the selected pixel to be turned on or off depending on display contents designated by the display signal, and sequentially turning on two neighboring grid electrodes in accordance with a synchronization signal included in the display signal to thereby display one frame.

Referring to FIGS. 4A to 4C, pixels of the 8-tuple anode matrix VFD will be described in detail. There are eight combinations for one pixel formed of four successive anode segments selected from eight anode segments facing two adjacent grid electrodes which are turned on at the same time. The combinations include: a pixel of anode segments A, B, C and D; a pixel of anode segments B, C, D and E; a pixel of anode segments C, D, E and F; a pixel of anode segments D, E, F and G; a pixel of anode segments E, F, G and H; a pixel of anode segments F, G, H and A; a pixel of anode segments G, H, A and B; and a pixel of anode segments H, A, B and C. Further, a pixel formed of four successive anode segments in which at least one of the four anode segments faces one of the grid electrodes and the other one or more anode segments face the other grid electrode has six combinations excluding the pixel of the anode segments A, B, C and D and the pixel of the anode segments E, F, G and H.

Referring to FIGS. 4A to 4C, an example of selected pixels of the 8-tuple anode matrix VFD will be described in detail. FIG. 4A shows a selected pixel including the anode segments C, D, E and F. FIG. 4B shows a selected pixel including the anode segments G, H, A and B. FIG. 4C shows a selected pixel including the anode segments C, D, E and F. In FIGS. 4A to 4C, in each set of four anode segments facing one of the neighboring grid electrodes which are turned on by simultaneously applying a positive voltage thereto, two anode segments close to the other of the two neighboring grid electrodes are selected, so that four selected anode segments are included in a selected pixel, and the selected pixel is turned on to emit lights, thereby making a display brightness uniform.

In controlling the anode segments, all anode segments in each row are controlled at the same time in synchronization with selection of grid electrodes. It is selectively controlled to allow the anode segments to emit lights depending on whether to turn on or off the anode inlet line of each row. That is, the selected pixel is formed of anode segments connected to a turned-on anode inlet line, whereas no selected pixel is formed of an anode segment connected to a turned-off anode inlet line. As described above, the selected pixels are controlled row by row. A driving circuit responsible for such control of the selected pixels will be described in detail later.

Referring to FIGS. 4A to 4C, how to select anode segments included in a selected pixel will be described in detail. First, difference in brightness between anode segments included in a selected pixel will be described. For example, when the grid electrodes $G_1$ and $G_2$ are turned on and the grid electrode $G_3$ is turned off and a selected pixel including anode segments G and F is turned on to emit lights (these light-emitting states are not shown in FIGS. 4A to 4C), the anode segment G is lower in brightness than the anode segment F. Also, when the grid electrodes $G_1$ and $G_2$ are turned on and the grid electrode $G_3$ is turned off and a selected pixel including anode segments H and G is turned on to emit lights (these light-emitting states are not shown in FIGS. 4A to 4C), the anode segment H is lower in brightness than the anode segment G. Such brightness difference is caused by the effect of the turned-off grid electrode $G_3$ which becomes stronger to an anode segment from a position closest thereto, so that the effect of the turned-off grid electrode $G_3$ to the anode segment H, the anode segment G and the anode segment F becomes weaker in that order.

Further, when the grid electrodes $G_1$ and $G_2$ are turned on and the grid electrode $G_3$ is turned off and the selected pixel including anode segments C, D, E and F is turned on to emit lights (FIG. 4(*a*)), the anode segment F becomes lower in brightness than the anode segment E, and a difference in brightness is generated within the region of the anode segment F, which has been observed by the inventors described in this application. Likewise, the anode segment C becomes lower in brightness than the anode segment D, and a difference in brightness is generated within the region of the anode segment C.

Figure 5:
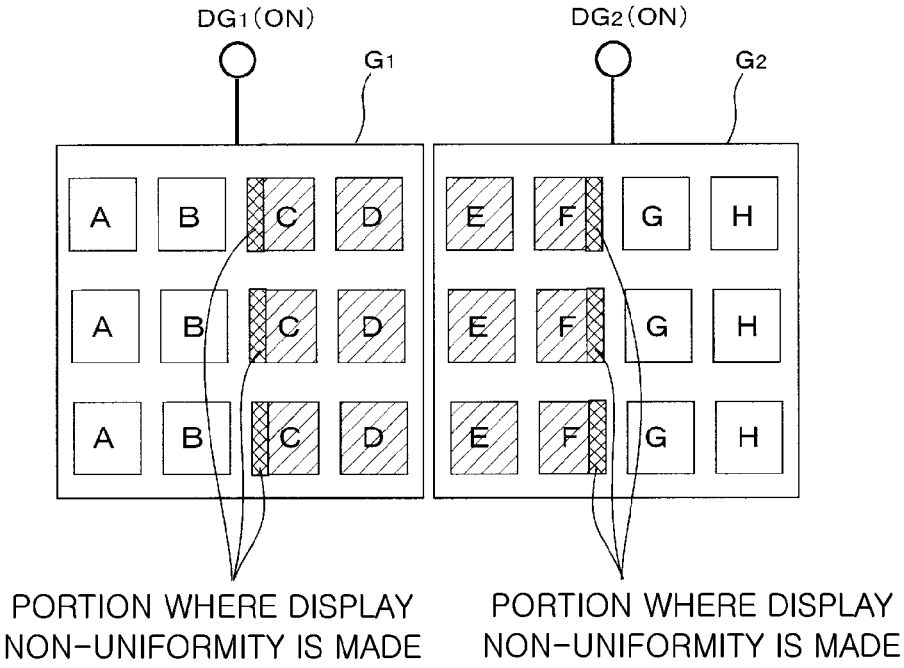
FIG. 5 schematically shows a defective display area including a region of an anode segment displaying brightness difference (defective display or dark lines)

FIG. 5 schematically shows a defective display area including a region of the anode segment C in which a brightness difference (display non-uniformity or dark line) is generated; and a region of the anode segment F in which a brightness difference (display non-uniformity or dark lines) is generated. Such display defects are generated on the opposite end portions of the selected pixel (including the anode segments C, D, E and F in FIG. 4A). Here, anode segments adjacent to the opposite end portions of the selected pixel are turned off. Such differences in brightness are caused by the turned-off anode segments B and G, adjacent to end portions of the selective pixel, affecting the anode segment C and F, respectively.

As a result of such display non-uniformities, dark lines (lines formed by light emitting portions which are decreased in brightness by one step) are formed in the longitude direction, resulting in deterioration in display quality. The length of dark lines in the longitude direction changes depending on displayed contents (images). When boundary lines between bright and dark portions extend in the longitude direction, undesired vertical and long dark lines may be visible to the human eyes in the bright portions around the boundary lines, causing remarkable deterioration in display quality.

Figure 6:
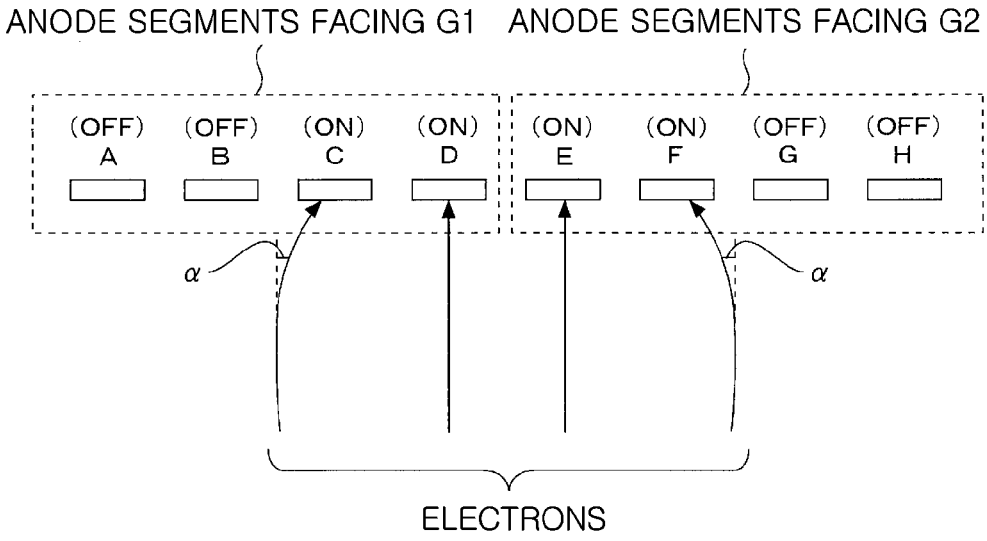
FIG. 6 schematically shows a cause of defective display.

FIG. 6 schematically shows how display non-uniformities are formed. Electrons are accelerated by a turned-on anode segment. When an equipotential surface is parallel with a surface on which the anode segments are disposed, electrons collide with turned-on anode segments vertically, and the anode segments C, D, E and F emit lights at the same level of brightness. However, since the anode segments B and G are turned off, the equipotential surface is not parallel with the surface on which the anode segments are disposed around the opposite end portions of the selected pixel. Thus, electrons are bent inwards in the anode segments C and F around the opposite end portions of the selected pixel (see angle $\alpha$ in FIG. 6). This phenomenon is called the vignetting effect.

Due to the vignetting effect, electrons are bent by the turned-off anode segment G, and thus dark lines appear at a periphery of the anode segment F close to the anode segment G. Likewise, electrons are bent by the turned-off anode segment B, and thus dark lines appear at a periphery of the anode segment C close to the anode segment B.

Figure 7A:
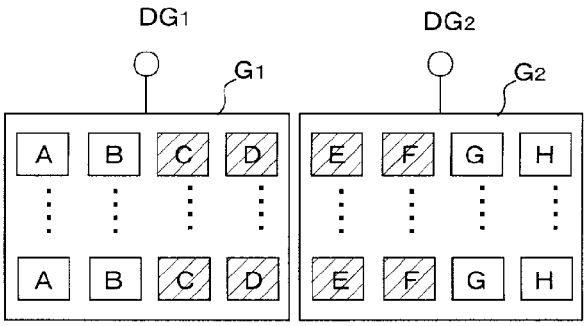
FIGS. 7A to 7C schematically show a method of driving the VFD in accordance with the present embodiment.
Figure 7B:
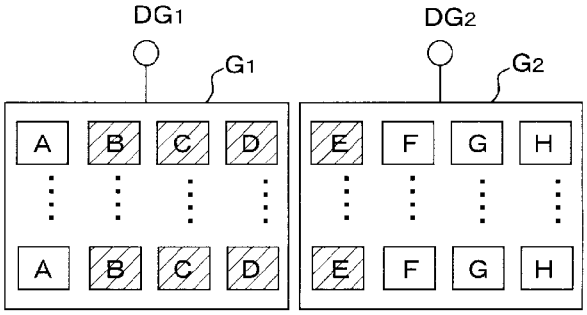
Figure 7C:
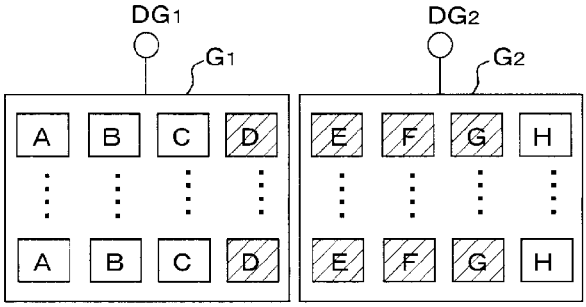
Figure 8A:
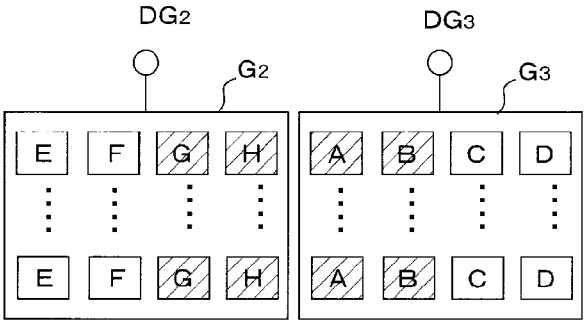
FIGS. 8A to 8C schematically show a method of driving the VFD in accordance with the present embodiment.
Figure 8B:
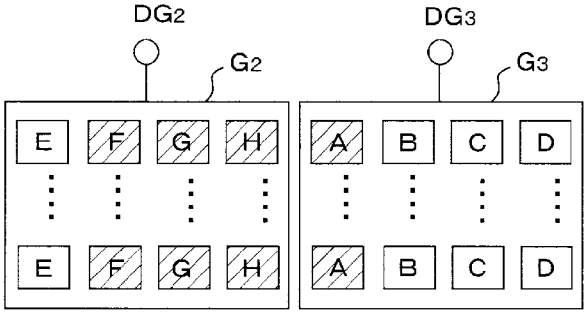
Figure 8C:
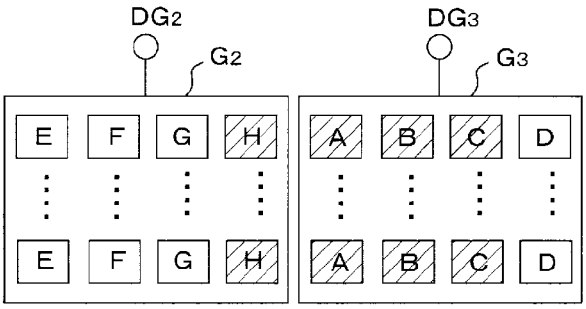

FIGS. 7A to 8C schematically show a method of driving the VFD in accordance with the present embodiment. In FIGS. 7A to 7C, the grid electrodes $G_1$ and $G_2$ are turned on as the first and the second grid electrode, respectively. In FIGS. 8A to 8C, the turned-on grid electrodes are changed to the grid electrodes $G_2$ and $G_3$ as the first and the second grid electrode, respectively. In the present embodiment, dark lines are prevented from being formed by changing the relative position of a light-emitting selected pixel to the grid electrodes in each frame. FIGS. 7A and 8A show a display mode in a first frame, FIGS. 7B and 8B show a display mode in a second frame, and FIGS. 7C and 8C show a display mode in a third frame. That is, the display modes in the first to third frames are repeated, and three frames are displayed as one set on the VFD. Here, one frame refers to one-time display on the entire surface of the VFD.

The following description is made in case that the grid electrodes $G_1$ and $G_2$ are turned on. As shown in FIG. 7A, the selected pixel includes the anode segments C, D, E and F in the first frame. To allow the selected pixel to emit lights, a positive voltage is applied to the anode segments to turn them on. To allow the selected pixel to emit no lights, a positive voltage is not applied to the anode segments to turn them off. This on and off control are performed in accordance with the contents included in a display signal (see FIG. 9) from the outside. As shown in FIG. 7B, the selected pixel includes the anode segments B, C, D and E in the second frame. As shown in FIG. 7C, the selected pixel includes the anode segments D, E, F and G in the third frame.

The following description is made in case that the grid electrodes $G_2$ and $G_3$ are turned on. As shown in FIG. 8A, the selected pixel includes the anode segments G, H, A and B in the first frame. As shown in FIG. 8B, the selected pixel includes the anode segments F, G, H and A in the second frame. As shown in FIG. 8C, the selected pixel includes the anode segments H, A, B and C in the third frame.

In this manner, the light emitting anode segments are disposed differently in each frame, thereby preventing appearance of dark lines. Further, displayed contents are changed fast during the period of one set (three frames), and the period of one set is shorter than the persistence period of an afterimage. Thus, even though a dark line occurs in the longitude direction in each frame, the dark line appears at different position in each frame, so that the dark line is not visible to the human eyes as a line by an afterimage.

Figure 9:
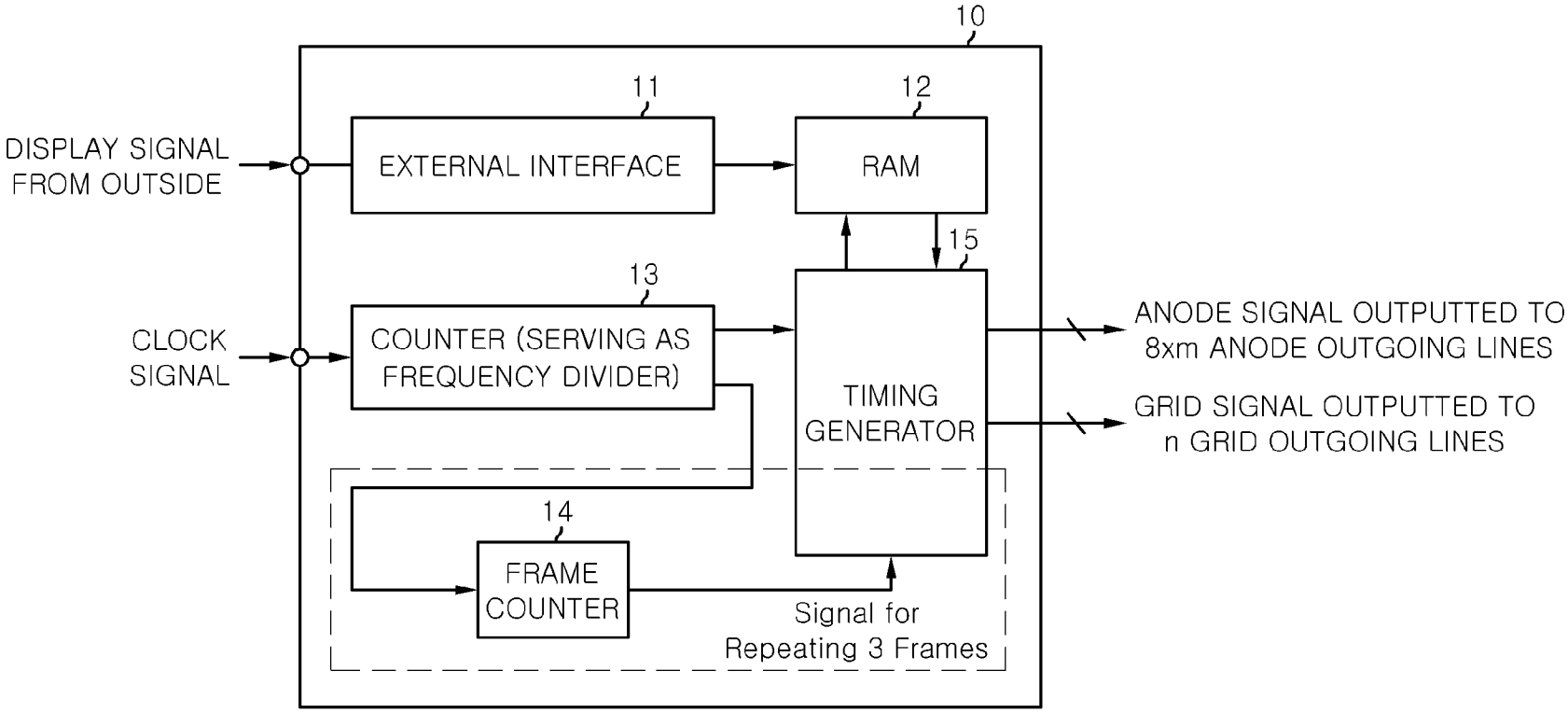
FIG. 9 is a block diagram of a driving circuit which drives the VFD in accordance with the embodiment.

FIG. 9 is a block diagram of a driving circuit 10 which drives the VFD in accordance with the present embodiment. The driving circuit 10 is programmed to have instructions to control the VFD driving methods described in the embodiments of the present invention and includes an external interface 11, an RAM 12, a counter 13, a frame counter 14, and a timing generator 15. A dotted-line part of the driving circuit 10 is a preventing unit for preventing appearance of dark lines. The preventing unit includes the frame counter 14 and a part of the timing generator 15.

A display signal from the outside, a time series signal, is inputted to the RAM 12 through the external interface 11. The RAM 12 stores a display signal from the outside in each preset region thereof to display a two-dimensional image on the VFD based on the display signal. The timing generator 15 reads out the display signal stored in each of the preset regions of the RAM 12 by using as a reference clock signal a timing generator clock signal obtained by performing frequency division of a clock signal as a master clock. Further, a signal for repeatedly selecting any one of the first frame, the second frame and the third frame is outputted from the frame counter 14 to the timing generator 15. The timing generator 15 outputs m anode signals in total to the respective anode inlet lines $DA_1$ to $DA_m$. Also, the timing generator 15 outputs n grid signals in total to the respective grid inlet lines $DG_1$ to $DG_n$.

Figure 10:
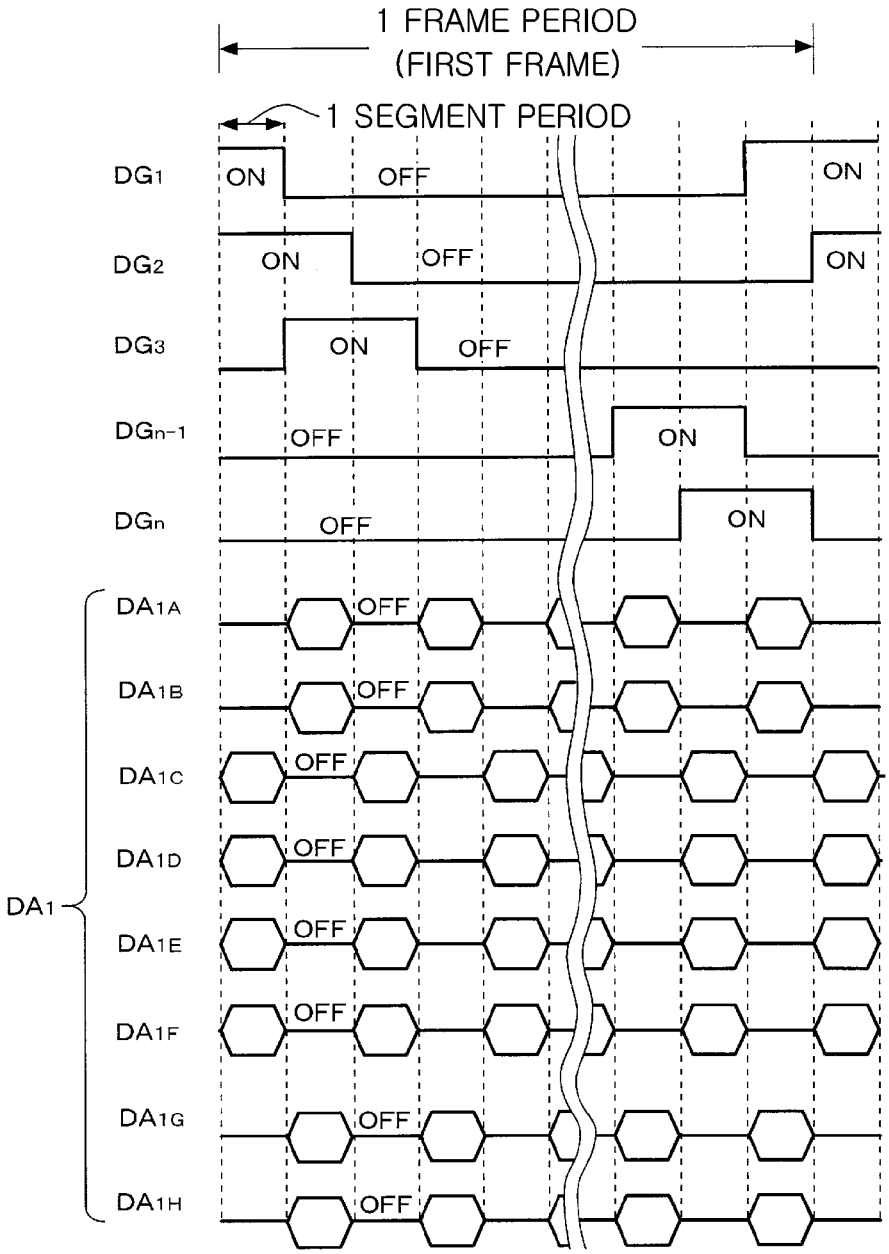
FIG. 10 is a timing view of a first frame.
Figure 11:
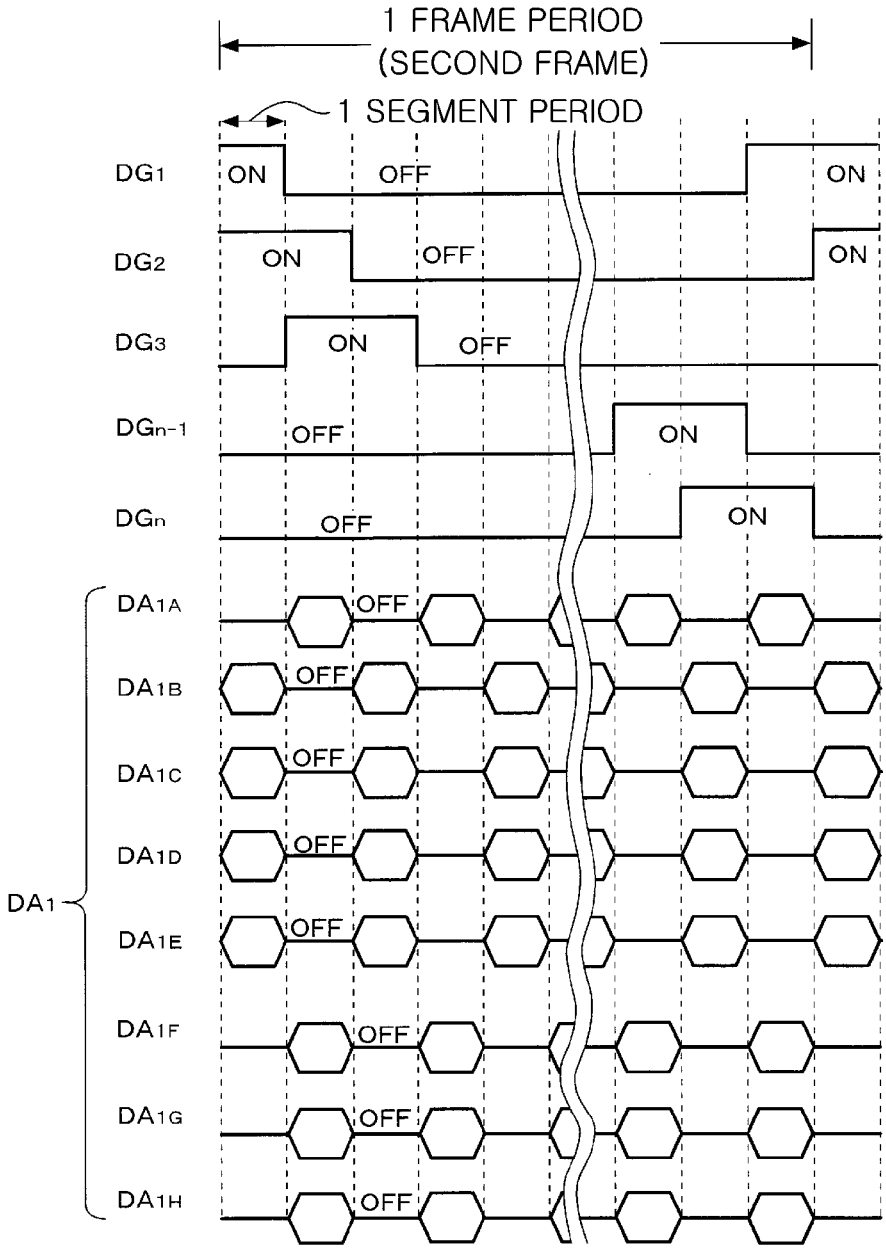
FIG. 11 is a timing view of a second frame.
Figure 12:
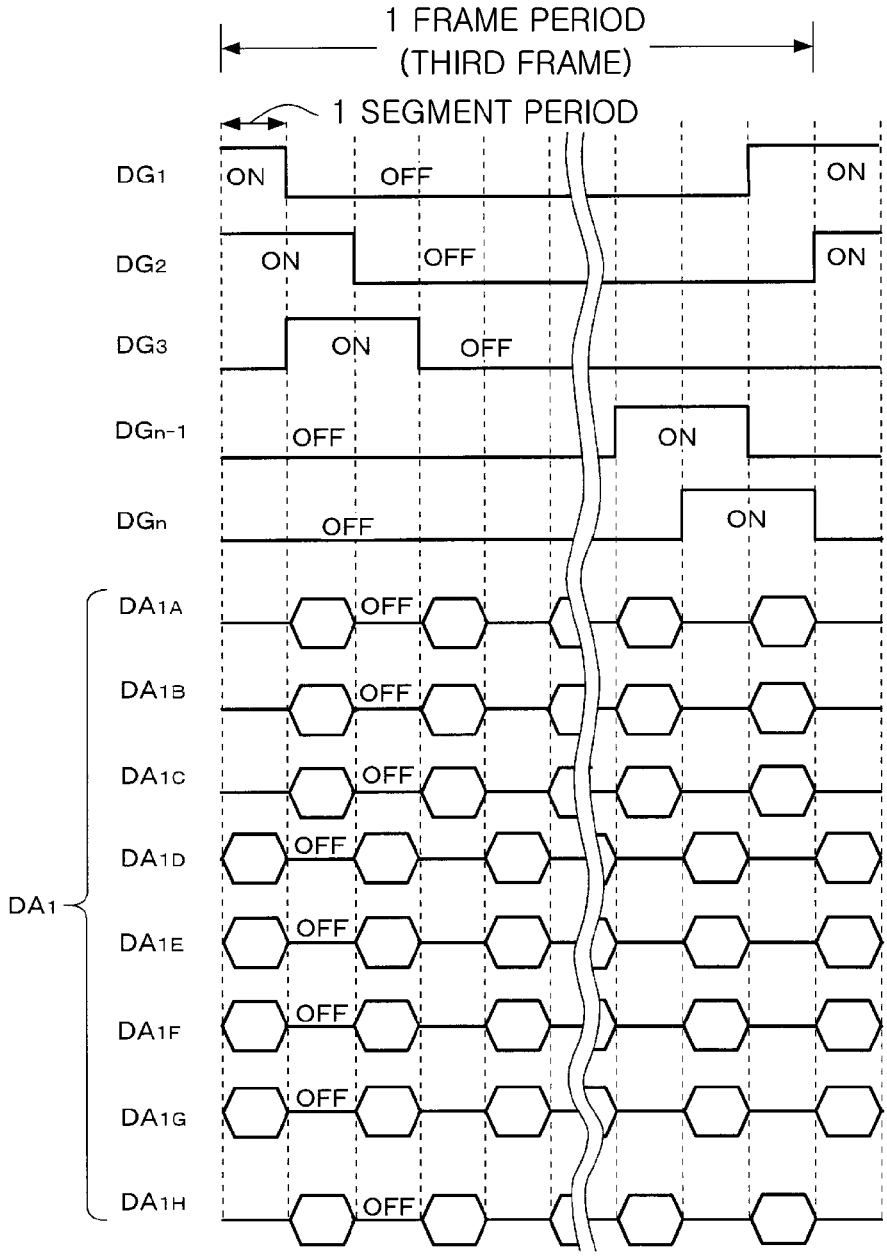
FIG. 12 is a timing view of a third frame.

FIGS. 10 to 12 are timing views of anode signals outputted to the anode inlet lines $DA_1$ and grid signals respectively outputted to the grid inlet lines $DG_1$ to $DG_n$. Here, a frame period refers to a period during which one-time display is updated on the entire surface of the VFD, that is, a period from a start point to an end point when the grid electrodes are sequentially turned on, wherein the start point is defined as a time point when the first grid electrode is changed from an OFF state to an ON state and the end point is defined as a time point when the last grid electrode is changed from the ON state to the OFF state. Further, the period of one segment refers to a minimum period during which an anode segment is changed from an OFF state to an ON state. The period of one segment also refers to a minimum period during which grid electrodes switch between on and off, and each grid electrode is turned on for the period of two segments.

FIGS. 10 to 12 are timing views of the first frame, the second frame and the third frame, respectively. FIGS. 10 to 12 do not show grid inlet lines $DG_4$ to $DG_{n-2}$ and anode inlet lines $DA_2$ to $DA_m$.

As shown in FIG. 10, when grid electrode inlet lines $DG_1$ and $DG_2$ are turned on so that grid electrodes $G_1$ and $G_2$ are turned on as first and second grid electrodes, respectively, in the first frame, anode segments C, D, E and F included in a selected pixel are independently and simultaneously turned on (in high level in FIG. 10) in one segment period in accordance with a display signal from the outside, and other anode segments than the selected pixel are turned off.

When grid electrode inlet lines $DG_2$ and $DG_3$ are turned on so that grid electrodes $G_2$ and $G_3$ are turned on as the first and second grid electrodes, respectively, in the first frame, anode segments G, H, A and B included in a selected pixel are independently and simultaneously turned on in one segment period in accordance with a display signal from the outside, and other anode segments than the selected pixel are turned off.

As shown in FIG. 11, when the grid electrode inlet lines $DG_1$ and $DG_2$ are turned on so that the grid electrodes $G_1$ and $G_2$ are turned on as the first and second grid electrodes, respectively, in the second frame, anode segments B, C, D and E included in a selected pixel are independently and simultaneously turned on (in high level in FIG. 11) in one segment period in accordance with a display signal from the outside, and other anode segments than the selected pixel are turned off.

Also, when the grid electrode inlet lines $DG_2$ and $DG_3$ are turned on so that the grid electrodes $G_2$ and $G_3$ are turned on as the first and second grid electrodes, respectively, in the second frame, anode segments F, G, H and A included in a selected pixel are independently and simultaneously turned on in one segment period in accordance with a display signal from the outside, and other anode segments than the selected pixel are turned off.

As shown in FIG. 12, when the grid electrode inlet lines $DG_1$ and $DG_2$ are turned on so that the grid electrodes $G_1$ and $G_2$ are turned on as the first and second grid electrodes, respectively, in the third frame, anode segments D, E, F and G included in a selected pixel are independently and simultaneously turned on (in high level in FIG. 12) in one segment period in accordance with a display signal from the outside, and other anode segments than the selected pixel are turned off.

Also, when the grid electrode inlet lines $DG_2$ and $DG_3$ are turned on so that the grid electrodes $G_2$ and $G_3$ are turned on as the first and second grid electrodes, respectively, in the third frame, anode segments H, A, B and C included in a selected pixel are independently and simultaneously turned on in one segment period in accordance with a display signal from the outside, and other anode segments than the selected pixel are turned off.

Here, a period (period of one frame) during which the grid electrode $G_1$ to the grid electrode $G_n$ are sequentially turned on by two adjacent grid electrodes at a time is, for example, about 20 msec. By driving the VFD in this manner, average brightness in each frame is visible to the human eyes, and thus dark lines become invisible thereto.

In addition to the pixels illustrated in FIGS. 10 to 12, there may be the following combinations for a pixel in one frame. In the following description, grid electrodes $G_1$ and $G_3$ are illustrated as odd-numbered grid electrodes and a grid electrode $G_2$ is illustrated as an even-numbered grid electrode.

If the grid electrode $G_1$ (odd-numbered) and the grid electrode $G_2$ (even-numbered) are turned on and a selected pixel includes anode segments C, D, E and F (see FIG. 10), the selected pixel may include anode segments F, G, H and A (see FIG. 11) or anode segments H, A, B and C (see FIG. 12) when the grid electrode $G_2$ (even-numbered) and the grid electrode $G_3$ (odd-numbered) are turned on.

If the grid electrode $G_1$ (odd-numbered) and the grid electrode $G_2$ (even-numbered) are turned on and a selected pixel includes anode segments B, C, D and E (see FIG. 11), the selected pixel may include anode segments G, H, A and B (see FIG. 10) or anode segments H, A, B and C (see FIG. 12) when the grid electrode $G_2$ (even-numbered) and the grid electrode $G_3$ (odd-numbered) are turned on.

If the grid electrode $G_1$ (odd-numbered) and the grid electrode $G_2$ (even-numbered) are turned on and a selected pixel includes anode segments D, E, F and G (see FIG. 12), the selected pixel may include anode segments G, H, A and B (see FIG. 10) or anode segments F, G, H and A (see FIG. 11) when the grid electrode $G_2$ (even-numbered) and the grid electrode $G_3$ (odd-numbered) are turned on.

Furthermore, the selected pixel is not only turned on in each frame as described above, but may also be turned on during one frame as follows. When the grid electrode $G_1$ (odd-numbered) and the grid electrode $G_2$ (even-numbered) are turned on, a selected pixel may be turned on as any one among a pixel including anode segments C, D, E and F; a pixel including anode segments B, C, D and E; and a pixel including anode segments D, E, F and G. When the grid electrode $G_2$ (even-numbered) and the grid electrode $G_3$ (odd-numbered) are turned on, a selected pixel may become any one among a pixel including anode segments G, H, A and B; a pixel including anode segments F, G, H and A; and a pixel including anode segments H, A, B and C.

The 8-tuple anode matrix VFD of the present embodiment is driven by the foregoing driving method, thereby providing following effects.

First, as four segments are turned on at the same time in one segment period, the 8-tuple anode matrix VFD has a duty factor four times higher than that of a single matrix VFD. As a result, the VFD of the present embodiment obtains a brightness that is four times higher than the single matrix type. In other words, the VFD of the present embodiment may use a lower voltage of grid electrodes than the single matrix VFD having the same number of segments so as to obtain the same level of brightness. As the voltage of the grid electrodes is reduced, the voltage of a power source circuit may be lowered, and accordingly the environment where the VFD can be used for graphic display can be expanded. Further, a driving element having a withstand voltage may be used for driving the grid electrode, and thus costs for not only a driving element but a driving apparatus may be reduced.

Further, it is possible to reduce a deterioration in display quality caused by potentials of turned-off grid electrodes that are respectively adjacent to the turned-on grid electrodes by turning on a plurality of selected pixels one by one to emit lights, wherein each selected pixel is formed of four anode segments to be turned on to emit lights by turning on a first and a second grid electrode (see FIGS. 10 to 12), the four anode segments including X (1 to 3) anode segments sequentially disposed from a position closest to the first grid electrode and facing the second grid electrode and Y (4−X) anode segments sequentially disposed from a position closest to the second grid electrode and facing the first grid electrode.

It is also possible to reduce a deterioration in display quality, i.e., a display non-uniformity, caused by potentials of turned-off anode segments that are respectively adjacent to the turned-on anode segments by repeating the following three frames as one set in proper order. The first frame shown in FIG. 10 is obtained by turning on a selected pixel to emit lights, the selected pixel including two anode segments sequentially disposed from a position closest to the first grid electrode and facing the second grid electrode and two anode segments sequentially disposed from a position closest to the second grid electrode and facing the first grid electrode.

The second frame shown in FIG. 11 is obtained by turning on a selected pixel to emit lights, the selected pixel including one anode segment disposed from a position closest to the first grid electrode and facing the second grid electrode and three anode segments sequentially disposed from a position closest to the second grid electrode and facing the first grid electrode. The third frame shown in FIG. 12 is obtained by turning on a selected pixel to emit lights, the selected pixel including three anode segments sequentially disposed from a position closest to the first grid electrode and facing the second grid electrode and one anode segment disposed from a position closest to the second grid electrode and facing the first grid electrode.

A modified example of the first embodiment will be described as follows.

Instead of repeating the first frame, the second frame and the third frame in that order, the first to third frames may be selected in random order and repeated as one set. For example, the third frame, the second frame and the first frame may be sequentially repeated, thereby reducing a deterioration in display quality, a display non-uniformity, caused by the potentials of turned-off anode segments that are respectively adjacent to turned-on anode segments, that is, defective display.

FIGS. 13A to 13E are conceptual views illustrating a 16-tuple anode matrix VFD in accordance with another example of the present embodiment. The 16-tuple anode matrix VFD may also employ the same driving method as used by the 8-tuple anode matrix VFD described above. FIGS. 13A to 13E respectively show the states of a first frame to a fifth frame when grid electrodes $G_1$ and $G_2$ are turned on as the first and the second grid electrode, respectively. In the 16-tuple anode matrix VFD, one group includes 16 anode segments A, B, C, D, E, F, G, H, I, J, K, L, M, N, O and P.

Figure 13A:
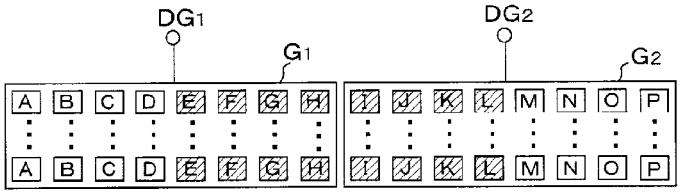
FIGS. 13A to 13E are conceptual views illustrating a 16-tuple anode matrix VFD in accordance with the present embodiment.

As shown in FIG. 13A, in the first frame, a selected pixel includes anode segments E, F, G, H, I, J, K and L, which are independently and simultaneously turned on in one segment period in accordance with a display signal from the outside, and the other anode segments are turned off when the grid electrodes $G_1$ and $G_2$ are turned on as the first and second grid electrodes, respectively.

Figure 13B:
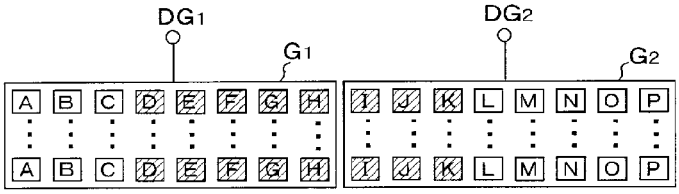

As shown in FIG. 13B, in the second frame, a selected pixel includes anode segments D, E, F, G, H, I, J and K, which are independently and simultaneously turned on in one segment period in accordance with a display signal from the outside, and the other anode segments are turned off when the grid electrodes $G_1$ and $G_2$ are turned on as the first and second grid electrodes, respectively.

Figure 13C:
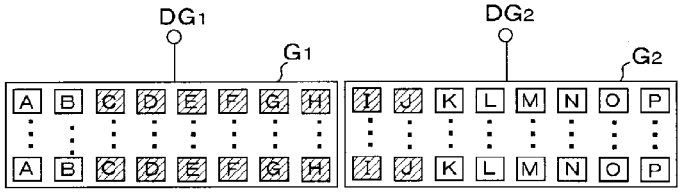

As shown in FIG. 13C, in the third frame, a selected pixel includes anode segments C, D, E, F, G, H, I and J, which are independently and simultaneously turned on in one segment period in accordance with a display signal from the outside, and the other anode segments are turned off when the grid electrodes $G_1$ and $G_2$ are turned on as the first and second grid electrodes, respectively.

Figure 13D:
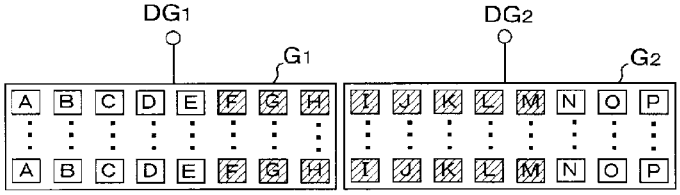

As shown in FIG. 13D, in the fourth frame, a selected pixel includes anode segments F, G, H, I, J, K, L and M, which are independently and simultaneously turned on in one segment period in accordance with a display signal from the outside, and the other anode segments are turned off when the grid electrodes $G_1$ and $G_2$ are turned on as the first and second grid electrodes, respectively.

Figure 13E:
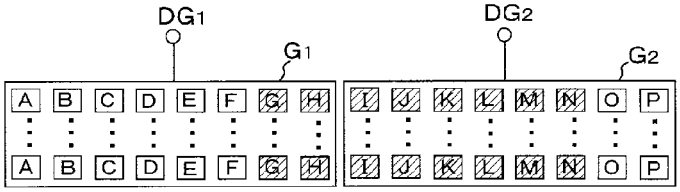

As shown in FIG. 13E, in the fifth frame, a selected pixel includes anode segments G, H, I, J, K, L, M and N, which are independently and simultaneously turned on in one segment period in accordance with a display signal from the outside, and the other anode segments are turned off when the grid electrodes $G_1$ and $G_2$ are turned on as the first and second grid electrodes, respectively.

Also, when the grid electrode $G_2$ and a grid electrode $G_3$ (adjacent to the grid electrode $G_2$, not shown in FIGS. 13A to 13E) are turned on as a first and a second grid electrode, respectively, a selected pixel is formed as follows. In the first frame, the selected pixel includes anode segments M, N, O, P, A, B, C and D. In the second frame, the selected pixel includes anode segments L, M, N, O, P, A, B and C. In the third frame, the selected pixel includes anode segments K, L, M, N, O, P, A and B. In the fourth frame, the selected pixel includes anode segments N, O, P, A, B, C, D and E. In the fifth frame, the selected pixel includes anode segments O, P, A, B, C, D, E and F.

In other words, in the first frame, the selected pixel is turned on to emit lights, wherein the selected pixel is formed of total eight anode segments selected from 16 anode segments to be turned on to emit lights by turning on two adjacent grid electrodes (a first and a second grid electrode), the eight anode segments including four anode segments sequentially disposed from a position closest to the first grid electrode and facing the second grid electrode and four anode segments sequentially disposed from a position closest to the second grid electrode and facing the first grid electrode.

In the second frame, the selected pixel is turned on to emit lights, wherein the selected pixel is formed of total eight anode segments selected from 16 anode segments to be turned on to emit lights by turning on two adjacent grid electrodes (a first and a second grid electrode), the eight anode segments including three anode segments sequentially disposed from a position closest to the first grid electrode and facing the second grid electrode and five anode segments sequentially disposed from a position closest to the second grid electrode and facing the first grid electrode.

In the third frame, the selected pixel is turned on to emit lights, wherein the selected pixel is formed of total eight anode segments selected from 16 anode segments to be turned on to emit lights by turning on two adjacent grid electrodes (a first and a second grid electrode), the eight anode segments including two anode segments sequentially disposed from a position closest to the first grid electrode and facing the second grid electrode and six anode segments sequentially disposed from a position closest to the second grid electrode and facing the first grid electrode.

In the fourth frame, the selected pixel is turned on to emit lights, wherein the selected pixel is formed of total eight anode segments selected from 16 anode segments to be turned on to emit lights by turning on two adjacent grid electrodes (a first and a second grid electrode), the eight anode segments including five anode segments sequentially disposed from a position closest to the first grid electrode and facing the second grid electrode and three anode segments sequentially disposed from a position closest to the second grid electrode and facing the first grid electrode.

In the fifth frame, the selected pixel is turned on to emit lights, wherein the selected pixel is formed of total eight anode segments selected from 16 anode segments to be turned on to emit lights by turning on the two adjacent grid electrodes (the first and the second grid electrode), the eight anode segments including six anode segments sequentially disposed from a position closest to the first grid electrode and facing the second grid electrode and two anode segments sequentially disposed from a position closest to the second grid electrode and facing the first grid electrode.

A technical concept of an M-tuple anode matrix VFD of the present embodiment can be generalized as follows, wherein M is an integer that is represented by $2^K$, K being an integer that is 3 or greater.

The M-tuple anode matrix VFD has a configuration including a plurality of rows of anode segments and a plurality of columns of grid electrodes, the rows of anode segments and the columns of grid electrodes being disposed in a matrix form such that each of the grid electrodes faces M/2 anode segments in each row of anode segments. Each row of anode segments includes anode segments divided into a number of groups, each group having M anode segments and M anode inlet lines formed by laterally connecting anode segments located at same relative position in groups. The grid electrodes extend in the longitude direction perpendicular to the rows of anode segments and include grid inlet lines.

Here, the driving circuit may be disposed either outside or inside the M-tuple anode matrix VFD. When the driving circuit is disposed outside the VFD, the VFD having the configuration shown in FIG. 1 is connected to the driving circuit 10 shown in FIG. 9 through a plurality of wires. On the other hand, when the driving circuit is disposed inside the VFD, the VFD and the driving circuit are connected to each other through a few wires (leads).

Figure 14:
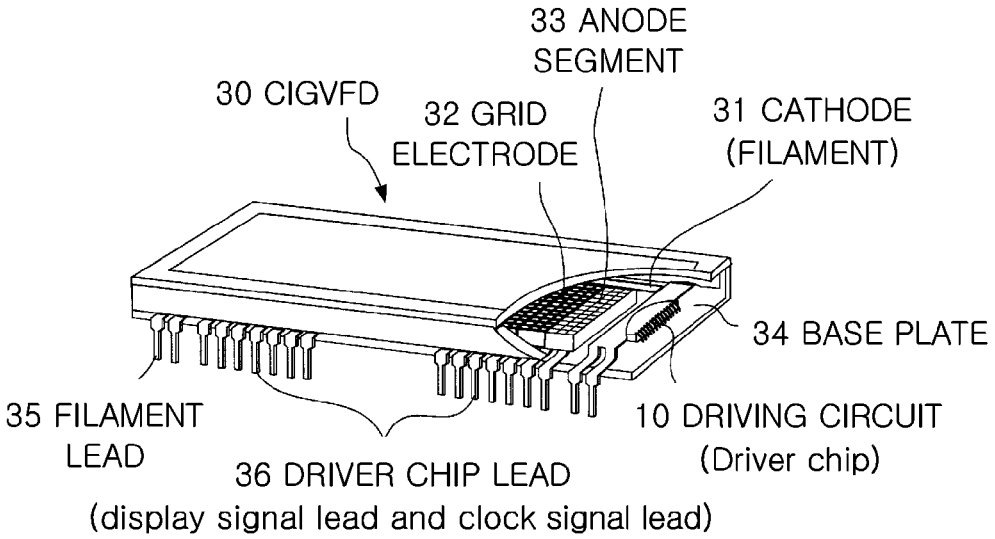
FIG. 14 is a perspective cross-sectional view of a chip in glass (CIG) VFD that is a VFD with a driving circuit mounted therein.

FIG. 14 is a perspective cross-sectional view of a chip in glass (CIG) VFD 30 with a driving circuit mounted therein. The CIGVFD 30 mainly includes a cathode 31, a grid electrode 32, an anode segment 33, a base plate 34, a filament lead 35, a driver chip lead 36 and a driving circuit 10.

The cathode 31 is formed by coating a tungsten core wire (filament) with Ba, Sr or Ca oxide. A voltage is applied across the filament, thereby generating electrons (thermoelectrons). The grid electrode 32 is the same as the grid electrodes $G_1$ to $G_n$ described above. The anode segment 33 is the same as the anode segments A to H. The base plate 34 is a glass substrate for which soda lime glass is employed, and has a vacuum inside. The filament lead 35 is connected to the filament of the cathode 31. The driver chip lead 36 includes a terminal through which a display signal (see FIG. 9) is inputted and a terminal through which a clock signal (see FIG. 9) is inputted. The driving circuit 10 may be formed of an integrated circuit (IC).

The cathode 31, the grid electrodes 32, the anode segments 33, the filament lead 35, the driver chip lead 36 and the driving circuit 10 are secured on the base plate 34 and patterns connecting these members are formed thereon. In this way, the driving circuit 10 is assembled in the CIGVFD 30, and accordingly a power lead including the filament lead 35 and the driver chip lead 36 may be used for electrodes for driving the CIGVFD 30 and the number of outside leads may be remarkably reduced.

The M-tuple anode matrix VFD is controlled by the driving circuit disposed either inside or outside the VFD as follows.

A plurality of selected pixels are turned on one by one to sequentially emit lights in accordance with a display signal, each selected pixel being formed of M/2 anode segments selected from M anode segments to be turned on to emit lights by turning on a first and a second grid electrodes positioned adjacent to each other.

The selected pixels include a first chosen pixel, one or more second chosen pixels, and one or more third chosen pixels. The first chosen pixel is formed of M/4 anode segments sequentially disposed from a position closest to the first grid electrode and facing the second grid electrode and M/4 anode segments sequentially disposed from a position closest to the second grid electrode and facing the first grid electrode.

The second chosen pixels are formed of (M/4−J) anode segments sequentially disposed from a position closest to the first grid electrode and facing the second grid electrode and (M/4+J) anode segments sequentially disposed from a position closest to the second grid electrode and facing the first grid electrode, wherein J is an integer ranging from 1 to $2^{(k-3)}$. In this case, the number of the selected pixels is $2^{(k-3)}$.

The third chosen pixels are formed of (M/4+J) anode segments sequentially disposed from a position closest to the first grid electrode and facing the second grid electrode and (M/4−J) anode segments sequentially disposed from a position closest to the second grid electrode and facing the first grid electrode, wherein J is an integer ranging from 1 to $2^{(k-3)}$. In this case, the number of the selected pixels is $2^{(k-3)}$.

Thus, the total number of selected pixels is $1+2^{(k-3)}+2^{(k-3)}$, and one selected pixel is turned on in each frame among all the selected pixels.

Next, the number of anode segments included in a selected pixel will be described. As described above, the number of anode segments which are turned on to emit lights concurrently by turning on two adjacent grid electrodes, that is, the number of anode segments included in a selected pixel, is four in the 8-tuple anode matrix type and eight in the 16-tuple anode matrix type in the present embodiment. In the M-tuple anode matrix type of the present embodiment, the number of anode segments included in a selected pixel is M/2.

The reason that the number of anode segments turned on to simultaneously emit lights is M/2 is to balance an effect of decreasing the influence of two turned-off grid electrodes respectively disposed on the right and left of two grid electrodes simultaneously turned on and an effect of improving a duty factor. In order to further reduce the influence of two turned off grid electrodes respectively disposed on the right and left of two grid electrodes simultaneously turned on, a selected pixel needs to have a fewer number of anode segments. Meanwhile, as a fewer number of anode segments constitutes a selected pixel, the duty factor becomes decreased.

The following description will be made on the case where the 8-tuple anode matrix type in accordance with the first embodiment is applied to the aforementioned generalization. In the 8-tuple anode matrix type, M=8, K=3, $2^{(K-3)}=1$, and J=1.

A plurality of selected pixels are turned on one by one to sequentially emit lights in accordance with a display signal, each selected pixel being formed of four (M/2) anode segments selected from eight (M) anode segments to be turned on to emit lights by turning on a first and a second grid electrode positioned adjacent to each other.

The selected pixels include a first chosen pixel, one or more second chosen pixels, and one or more third chosen pixels. The first chosen pixel is formed of two (M/4) anode segments sequentially disposed from a position closest to the first grid electrode and facing the second grid electrode and two anode segments (M/4) sequentially disposed from a position closest to the second grid electrode and facing the first grid electrode, among four (M/2) anode segments to be turned on to emit lights by turning on the two adjacent grid electrodes (the first and the second grid electrode) (see FIG. 7A).

The second chosen pixels is formed of one (M/4−J) anode segment disposed from a position closest to the first grid electrode and facing the second grid electrode and three anode segments (M/4+J) sequentially disposed from a position closest to the second grid electrode and facing the first grid electrode (see FIG. 7B).

The third chosen pixel is formed of three (M/4+J) anode segments sequentially disposed from a position closest to the first grid electrode and facing the second grid electrode and one anode segment (M/4−J) sequentially disposed from a position closest to the second grid electrode and facing the first grid electrode (see FIG. 7C).

The following description will be made on the case where the 16-tuple anode matrix type in accordance with the first embodiment is applied to the aforementioned generalization. In the 16-tuple anode matrix type, M=16, K=4, $2^{(K-3)}=2$, and J=1 and 2.

A plurality of selected pixels are turned on one by one to sequentially emit lights in accordance with a display signal, each selected pixel being formed of eight anode segments selected from 16 anode segments to be turned on to emit lights by turning on a first and a second grid electrode positioned adjacent to each other.

The selected pixels include a first chosen pixel, one or more second chosen pixels, and one or more third chosen pixels. The first chosen pixel is formed of four (M/4) anode segments sequentially disposed from a position closest to the first grid electrode and facing the second grid electrode and four anode segments (M/4) sequentially disposed from a position closest to the second grid electrode and facing the first grid electrode, among eight (M/2) anode segments to be turned on to emit lights by turning on the two adjacent grid electrodes (the first and the second grid electrode) (see FIG. 13A).

When J=1, the second chosen pixel is formed of three (M/4−J) anode segments sequentially disposed from a position closest to the first grid electrode and facing the second grid electrode and five (M/4+J) anode segments sequentially disposed from a position closest to the second grid electrode and facing the first grid electrode (see FIG. 13B).

When J=2, the second chosen pixel is formed of two (M/4−J) anode segments sequentially disposed from a position closest to the first grid electrode and facing the second grid electrode and six (M/4+J) anode segments sequentially disposed from a position closest to the second grid electrode and facing the first grid electrode (see FIG. 13C).

When J=1, the third chosen pixel is formed of five (M/4+J) anode segments sequentially disposed from a position closest to the first grid electrode and facing the second grid electrode and three (M/4−J) anode segments sequentially disposed from a position closest to the second grid electrode and facing the first grid electrode (see FIG. 13D).

When J=2, the third chosen pixel is formed of six (M/4+J) anode segments sequentially disposed from a position closest to the first grid electrode and facing the second grid electrode and two (M/4−J) anode segments sequentially disposed from a position closest to the second grid electrode and facing the first grid electrode (see FIG. 13E).

In the meantime, to prevent appearance of dark lines, an M-tuple anode matrix type in accordance with a second embodiment of the present invention may be employed, wherein M is a positive integer Q instead of an integer expressed by $2^K$. The number of anode segments included in a selected pixel is R that is a positive integer and smaller than Q, and at least one anode segment faces one of two adjacent electrodes and the other one or more anode segments face the other electrode. A plurality of selected pixels having anode segments of different arrangements satisfying the above condition is turned on one by one, thereby preventing appearance of dark lines.

The second embodiment of the present invention is related to a Q-tuple anode matrix VFD, and a driving circuit and method thereof. The Q-tuple anode matrix VFD includes a plurality of rows of anode segments and a plurality of columns of grid electrodes, the rows of anode segments and the columns of grid electrodes being disposed in a matrix form such that each of the grid electrodes faces Q/2 anode segments in each row of anode segments. Each row of anode segments includes anode segments divided into a number of groups, each group having Q anode segments and Q anode inlet lines formed by laterally connecting anode segments located at same relative positions in groups, Q being an even number that is 8 or greater. The grid electrodes extend in the longitude direction perpendicular to the rows of anode segments and include grid inlet lines.

A plurality of selected pixels are turned on one by one to sequentially emit lights in accordance with a display signal, each selected pixel being formed of Q/2 anode segments including R anode segments sequentially disposed from a position closest to a first grid electrode and facing a second grid electrode and (Q/2−R) anode segments sequentially disposed from a position closest to the second grid electrode and facing the first grid electrode, R ranging from 1 to (Q/2−1), selected from Q anode segments to be turned on to emit lights by turning on the first and the second grid electrode positioned adjacent to each other.

FIGS. 15A to 15E are conceptual views showing a 12-tuple anode matrix VFD in accordance with the present embodiment.

FIGS. 15A to 15E respectively show the states of a first frame to a fifth frame when grid electrodes $G_1$ and $G_2$ are turned on as first and second grid electrodes, respectively.

In the 12-tuple anode matrix type, one group includes 12 anode segments, for example, anode segments A, B, C, D, E, F, G, H, I, J, K and L.

Figure 15A:
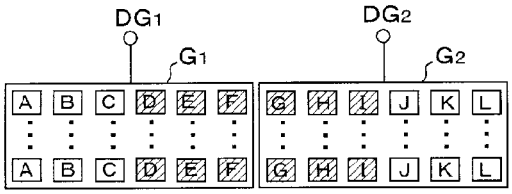
FIGS. 15A to 15E are conceptual views showing a 12-tuple anode matrix VFD in accordance with a second embodiment of the present invention.

As shown in FIG. 15A, in the first frame, anode segments D, E, F, G, H and I included in a selected pixel are independently and simultaneously turned on in one segment period in accordance with a display signal from the outside, and the other anode segments are turned off when the grid electrodes $G_1$ and $G_2$ are turned on as the first and second grid electrodes.

Figure 15B:
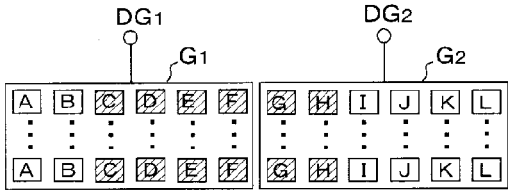

As shown in FIG. 15B, in the second frame, anode segments C, D, E, F, G and H included in a selected pixel are independently and simultaneously turned on in one segment period in accordance with a display signal from the outside, and the other anode segments are turned off when the grid electrodes $G_1$ and $G_2$ are turned on as first and second grid electrodes.

Figure 15C:
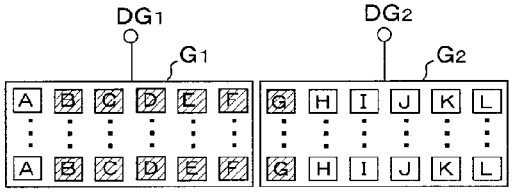

As shown in FIG. 15C, in the third frame, anode segments B, C, D, E, F and G included in a selected pixel are independently and simultaneously turned on in one segment period in accordance with a display signal from the outside, and the other anode segments are turned off when the grid electrodes $G_1$ and $G_2$ are turned on as first and second grid electrodes.

Figure 15D:
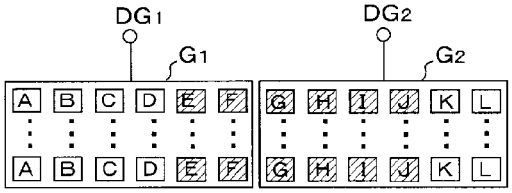

As shown in FIG. 15D, in the fourth frame, anode segments E, F, G, H, I and J included in a selected pixel are independently and simultaneously turned on in one segment period in accordance with a display signal from the outside, and the other anode segments are turned off when the grid electrodes $G_1$ and $G_2$ are turned on as first and second grid electrodes.

Figure 15E:
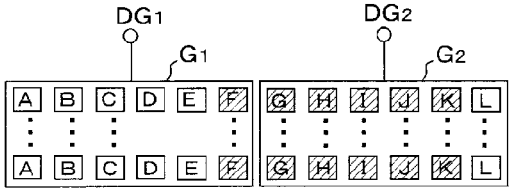

As shown in FIG. 15E, in the fifth frame, anode segments F, G, H, I, J and K included in a selected pixel are independently and simultaneously turned on in one segment period in accordance with a display signal from the outside, and the other anode segments are turned off when the grid electrodes $G_1$ and $G_2$ are turned on as first and second grid electrodes.

Further, when the grid electrode $G_2$ and a grid electrode $G_3$ (adjacent to the grid electrode $G_2$, not shown in FIGS. 15A to 15E) are turned on, a selected pixel is formed as follows.

In the first frame, the selected pixel is formed of anode segments J, K, L, A, B and C. In the second frame, the selected pixel is formed of anode segments I, J, K, L, A and B. In the third frame, the selected pixel is formed of anode segments H, I, J, K, L and A.

In the fourth frame, the selected pixel is formed of anode segments K, L, A, B, C and D. In the fifth frame, the selected pixel is formed of anode segments L, A, B, C, D and E.

In other words, in the first frame, total 6 anode segments included in the selected pixel are simultaneously turned on or off in one segment period in accordance with a display signal from the outside, wherein the 6 anode segments are selected from 12 anode segments to be turned on to emit lights by turning on two adjacent grid electrodes (a first and a second grid electrode) and include 3 anode segments sequentially disposed from a position closest to the first grid electrode and facing the second grid electrode and 3 anode segments sequentially disposed from a position closest to the second grid electrode and facing the first grid electrode.

In the second frame, total 6 anode segments included in the selected pixel are simultaneously turned on or off in one segment period in accordance with a display signal from the outside, wherein the 6 anode segments are selected from 12 anode segments to be turned on to emit lights by turning on two adjacent grid electrodes (a first and a second grid electrode) and include 2 anode segments sequentially disposed from a position closest to the first grid electrode and facing the second grid electrode and 4 anode segments sequentially disposed from a position closest to the second grid electrode and facing the first grid electrode.

In the third frame, total 6 anode segments included in the selected pixel are simultaneously turned on or off in one segment period in accordance with a display signal from the outside, wherein the 6 anode segments are selected from 12 anode segments to be turned on to emit lights by turning on two adjacent grid electrodes (a first and a second grid electrode) and include 1 anode segment disposed from a position closest to the first grid electrode and facing the second grid electrode and 5 anode segments sequentially disposed from a position closest to the second grid electrode and facing the first grid electrode.

In the fourth frame, total 6 anode segments included in a selected pixel are simultaneously turned on or off in one segment period in accordance with a display signal from the outside, wherein the 6 anode segments are selected from 12 anode segments to be turned on to emit lights by turning on two adjacent grid electrodes (a first and a second grid electrode) and include 4 anode segments sequentially disposed from a position closest to the first grid electrode and facing the second grid electrode and 2 anode segments sequentially disposed from a position closest to the second grid electrode and facing the first grid electrode.

In the fifth frame, total 6 anode segments included in a selected pixel are simultaneously turned on or off in one segment period in accordance with a display signal from the outside, wherein the 6 anode segments are selected from 12 anode segments to be turned on to emit lights by turning on two adjacent grid electrodes (a first and a second grid electrode) and include 5 anode segments sequentially disposed from a position closest to the first grid electrode and facing the second grid electrode and 1 anode segment disposed from a position closest to the second grid electrode and facing the first grid electrode.

The Q-tuple anode matrix type including the 12-tuple type as well as the 8-tuple type and 16-tuple type is generalized as follows. The Q-tuple anode matrix VFD includes a plurality of rows of anode segments and a plurality of columns of grid electrodes, the rows of anode segments and the grid electrodes being disposed in a matrix form such that each of the grid electrodes faces Q/2 anode segments in each row of anode segments. Each row of anode segments includes anode segments divided into a number of groups, each group having Q anode segments and Q anode inlet lines formed by laterally connecting anode segments located at same relative positions in groups, Q being an even number that is 8 or greater. The grid electrodes extend in the longitude direction perpendicular to the rows of anode segments and include grid inlet lines.

A plurality of selected pixels are turned on one by one to sequentially emit lights in accordance with a display signal, wherein each selected pixel is formed of Q/2 anode segments selected from Q anode segments to be turned on to emit lights by turning on the first and the second grid electrode positioned adjacent to each other, the Q/2 anode segments including R anode segments sequentially disposed from a position closest to the first grid electrode and facing the second grid electrode and (Q/2−R) anode segments sequentially disposed from a position closest to the second grid electrode and facing the first grid electrode, R being a positive integer ranging from 1 to (Q/2−1).

In the 8-tuple anode matrix type in accordance with the present embodiment, Q=8 and each of a first and a second grid electrode is disposed to face 4 (Q/2) anode segments. Further, a plurality of selected pixels are turned on one by one to sequentially emit lights in accordance with a display signal, each selected pixel belonging to one of 3 kinds of selected pixels. The selected pixels are formed of total 4 (Q/2) anode segments including R (in a range of 1, 2, and 3) anode segments sequentially disposed from a position closest to the first grid electrode and facing the second grid electrode and (Q/2−R) (in a range of 3, 2 and 1) anode segments sequentially disposed from a position closest to the second grid electrode and facing the first grid electrode, R ranging from 1 to (Q/2−1).

Here, a first selected pixel is formed of 2 anode segments facing the second grid electrode and 2 anode segments facing the first grid electrode. Further, a second selected pixel is formed of 1 anode segment facing the second grid electrode and 3 anode segments facing the first grid electrode. A third selected pixel is formed of 3 anode segments facing the second grid electrode and 1 anode segment facing the first grid electrode.

In the 12-tuple anode matrix type in accordance with the present embodiment, Q=12 and each of a first and a second grid electrode is disposed to face 6 (Q/2) anode segments. Further, a plurality of selected pixels are turned on one by one to sequentially emit lights in accordance with a display signal, each selected pixel belonging to one of 5 kinds of selected pixels. The selected pixels are formed from total 6 (Q/2) anode segments including R (in a range of 1, 2, 3, 4 and 5) anode segments sequentially disposed from a position closest to the first grid electrode and facing the second grid electrode and (Q/2−R) (in a range of 5, 4, 3, 2 and 1) anode segments sequentially disposed from a position closest to the second grid electrode and facing the first grid electrode, R ranging from 1 to (Q/2−1).

In the 16-tuple anode matrix type in accordance with the present embodiment, Q=16 and each of a first and a second grid electrode is disposed to face 8 (Q/2) anode segments. Further, a plurality of selected pixels are turned on one by one to sequentially emit lights in accordance with a display signal, each selected pixel belonging to one of 7 kinds of selected pixels. The selected pixels are formed from total 8 (Q/2) anode segments including R (in a range of 1, 2, 3, 4, 5, 6 and 7) anode segments sequentially disposed from a position closest to the first grid electrode and facing the second grid electrode and (Q/2−R) (in a range of 7, 6, 5, 4, 3, 2 and 1) anode segments sequentially disposed from a position closest to the second grid electrode and facing the first grid electrode, R ranging from 1 to (Q/2−1).

Here, a first selected pixel is formed of 4 anode segments facing the second grid electrode and 4 anode segments facing the first grid electrode. Further, a second selected pixel is formed of 3 anode segments facing the second grid electrode and 5 anode segments facing the first grid electrode. A third selected pixel is formed of 2 anode segments facing the second grid electrode and 6 anode segment facing the first grid electrode. A fourth selected pixel is formed of 1 anode segment facing the second grid electrode and 7 anode segments facing the first grid electrode.

A fifth selected pixel is formed of 5 anode segments facing the second grid electrode and 3 anode segments facing the first grid electrode. A sixth selected pixel is formed of 6 anode segments facing the second grid electrode and 2 anode segments facing the first grid electrode. A seventh selected pixel is formed of 7 anode segments facing the second grid electrode and 1 anode segment facing the first grid electrode.

The 16-tuple anode matrix VFD in accordance with the second embodiment has 7 kinds of selected pixels, which are more than 5 kinds of selected pixels in the 16-tuple anode matrix VFD in accordance with the first embodiment. Accordingly, appearance of dark lines can be further effectively prevented.

Further, in the 16-tuple anode matrix VFD where Q=16, R may be selected from 1 to (Q/2−1) as the number of anode segments facing one of two adjacent grid electrodes (a first and a second grid electrode). When a selected pixel is formed of (Q/2) anode segments in total including R anode segments sequentially disposed from a position closest to the first grid electrode and facing the second grid electrode and (Q/2−R) anode segments sequentially disposed from a position closest to the second grid electrode and facing the first grid electrode, R ranging from 2 to (Q/2−2), the same configuration as that of the 16-tuple anode matrix VFD having 5 kinds of selected pixels in accordance with the first embodiment is obtained.

In the Q-tuple anode matrix VFD, if Q is represented by $2^K$ and a selected pixel is formed of (Q/2) anode segments in total including R anode segments sequentially disposed from a position closest to the first grid electrode and facing the second grid electrode and (Q/2−R) anode segments sequentially disposed from a position closest to the second grid electrode and facing the first grid electrode, R ranging from $2^{(k-3)}$ to $(Q/2-2^{(k-3)})$, the Q-tuple anode matrix VFD is generally configured in accordance with the embodiments described above.

In the present embodiment, the VFD may be configured as a CIGVFD that is a VFD with a driving circuit mounted therein, as shown in FIG. 14.

The embodiments illustrated above may be combined as a new embodiment. For example, the 8-tuple anode matrix type in accordance with the first embodiment has 3 kinds of selected pixels, and the 16-tuple anode matrix type in accordance with the first embodiment has 5 kinds of selected pixels. Here, all selected pixels may be turned on to sequentially emit lights in accordance with a display signal. Alternatively, in the 8-tuple matrix type, an optional number of selected pixels may be turned on among the 3 kinds thereof to sequentially emit lights in accordance with a display signal. In the 16-tuple matrix type, an optional number of selected pixels may be turned on among the 5 kinds thereof to sequentially emit lights in accordance with a display signal.

In the second embodiment, the 8-tuple matrix type has 3 kinds of selected pixels, the 12-tuple matrix type has 5 kinds of selected pixels, and the 16-tuple matrix type has 7 kinds of selected pixels. Here, all selected pixels may be turned on to sequentially emit lights in accordance with a display signal.

Alternatively, in the 8-tuple matrix type, an optional number of selected pixels may be turned on among the 3 kinds thereof to sequentially emit lights in accordance with a display signal. In the 16-tuple matrix type, an optional number of selected pixels may be turned on among 5 kinds thereof to sequentially emit lights in accordance with a display signal. In the 16-tuple matrix type, an optional number of selected pixels may be turned on among the 7 kinds thereof to sequentially emit lights in accordance with a display signal.

While the invention has been shown and described with respect to the embodiments, it will be understood by those skilled in the art that various changes and modifications may be made without departing from the scope of the invention as defined in the following claims.

What is claimed is:

1. A Q-tuple anode matrix vacuum fluorescent display (VFD) comprising:

a driving circuit;

a plurality of rows of anode segments wherein each row of anode segments is divided into groups, each group having Q anode segments and Q anode inlet lines formed by laterally connecting anode segments located at same relative positions in the groups, Q being an even number that is 8 or greater; and a plurality of columns of grid electrodes extending in a longitude direction perpendicular to the rows of the anode segments, each having a grid inlet line, wherein the rows of the anode segments and the columns of the grid electrodes are disposed in a matrix form such that each of the grid electrodes faces Q/2 anode segments in each of the rows of the anode segments, wherein the driving circuit turns on, in one frame, a plurality of selected pixels one by one to sequentially emit lights in accordance with a display signal, each selected pixel being formed of Q/2 anode segments selected from a group of Q anode segments to be turned on to emit lights by turning on a first and a second grid electrode positioned adjacent to each other, wherein the Q/2 anode segments of each selected pixel are sequentially disposed and include at least one anode segment facing the first grid electrode and at least one anode segment facing the second grid electrode, and wherein, in multiple frames, R varies among integers from 1 to (Q/2−1), R being the number of said at least one anode segment facing the first grid electrode.

2. The VFD of claim 1, wherein R varies frame-by-frame and R's of (Q/2−1) sequential frames are different from each other.

3. A driving circuit of a Q-tuple anode matrix vacuum fluorescent display (VFD) which includes a plurality of rows of anode segments wherein each row of anode segments is divided into groups, each group having Q anode segments and Q anode inlet lines formed by laterally connecting anode segments located at same relative positions in the groups, Q being an even number that is 8 or greater; and a plurality of columns of grid electrodes extending in a longitude direction perpendicular to the rows of the anode segments, each having a grid inlet line, wherein the rows of anode segments and the columns of the grid electrodes are disposed in a matrix form such that each of the grid electrodes faces Q/2 anode segments in each of the rows of the anode segments, wherein the driving circuit turns on, in one frame, a plurality of selected pixels one by one to sequentially emit lights in accordance with a display signal, each selected pixel being formed of Q/2 anode segments selected from a group of Q anode segments to be turned on to emit lights by turning on a first and a second grid electrode positioned adjacent to each other, wherein the Q/2 anode segments of each selected pixel are sequentially disposed and include at least one anode segment facing the first grid electrode and at least one anode segment facing the second grid electrode, and wherein, in multiple frames, R varies among integers from 1 to (Q/2−1), R being the number of said at least one anode segment facing the first grid electrode.

4. The driving circuit of claim 3, wherein R varies frame-by-frame and R's of (Q/2−1) sequential frames are different from each other.

5. A method of driving a Q-tuple anode matrix vacuum fluorescent display (VFD) which includes a plurality of rows of anode segments wherein each row of anode segments is divided into groups, each groups having Q groups and Q anode inlet lines formed by laterally connecting anode segments located at same positions in the groups, Q being an even number that is 8 or greater; and a plurality of columns of grid electrodes extending in a longitude direction perpendicular to the rows of the anode segments, each having a grid inlet line, wherein the rows of the anode segments and the columns of the grid electrodes are disposed in a matrix form such that each of the grid electrodes faces Q/2 anode segments in each of the rows of the anode segments, the method comprising:

turning on, in one frame, a plurality of selected pixels one by one to sequentially emit lights in accordance with a display signal, each selected pixel being formed of Q/2 anode segments selected from a group of Q anode segments to be turned on to emit lights by turning on a first and a second grid electrode positioned adjacent to each other, wherein the Q/2 anode segments of each selected pixel are sequentially disposed and include at least one anode segment from a position closest to the first grid electrode and facing the first grid electrode and at least one anode segment facing the second grid electrode, and wherein, in multiple frames, R varies among integers from 1 to (Q/2−1), R being the number of said at least one anode segment facing the first grid electrode.

6. The method of claim 5, wherein R varies frame-by-frame and R's of (Q/2−1) sequential frames are different from each other.

7. An M-tuple anode matrix vacuum fluorescent display (VFD) comprising:

a driving circuit;

a plurality of rows of anode segments wherein each row of anode segments is divided into groups, each group having M anode segments and M anode inlet lines formed by laterally connecting anode segments located at same relative positions in the groups, M being an integer that is represented by $2^K$ and K being an integer that is 3 or greater; and a plurality of columns of grid electrodes extending in a longitude direction perpendicular to the rows of the anode segments, each having a grid inlet line, wherein a plurality of rows of the anode segments and a plurality of columns of the grid electrodes are disposed in a matrix form such that each of the grid electrodes faces M/2 anode segments in each of the rows of the anode segments, wherein the driving circuit turns on, in one frame, a plurality of selected pixels one by one to sequentially emit lights in accordance with a display signal, each selected pixel being formed of M/2 anode segments selected from a group of M anode segments to be turned on to emit lights by turning on a first and a second grid electrode positioned adjacent to each other, wherein the M/2 anode segments of each selected pixel are sequentially disposed and include at least $(M/4-2^{(k-3)})$ anode segments facing the first grid electrode and at least $(M/4-2^{(k-3)})$ anode segments facing the second grid electrode, and wherein, in multiple frames, R varies among integers from $(M/4-2^{(k-3)})$ to $(M/4+2^{(k-3)})$, R being the number of said at least $(M/4-2^{(k-3)})$ anode segments facing the first grid electrode.

8. The VFD of claim 7, wherein the VFD is formed in an 8-tuple anode matrix type in which each of the grid electrodes is disposed to face 4 anode segments of each of the rows of anode segments when M is 8 and K is 3, wherein the driving circuit turns on, in one frame, a plurality of selected pixels one by one to sequentially emit lights in accordance with a display signal, each selected pixel being formed of 4 anode segments selected from a group of 8 anode segments to be turned on to emit lights by turning on a first and a second grid electrode positioned adjacent to each other, wherein the 4 anode segments of each selected pixel are sequentially disposed and include at least one anode segment facing the first grid electrode and at least one anode segment facing the second grid electrode, and wherein, in multiple frames, R varies among integers from 1 to 3, R being the number of said at least one anode segment facing the first grid electrode.

9. The VFD of claim 7, wherein R varies frame-by-frame and R's of $(2^{(k-2)}+1)$ sequential frames are different from each other.

10. A driving circuit of an M-tuple anode matrix vacuum fluorescent display (VFD) which includes a plurality of rows of anode segments wherein each row of anode segments is divided into groups, each group having M anode segments and M anode inlet lines formed by laterally connecting anode segments located at same relative positions in the groups, M being an integer that is represented by $2^K$ and K being an integer that is 3 or greater; and a plurality of columns of grid electrodes extending in a longitude direction perpendicular to the row of the anode segments, each having a grid inlet line, wherein the rows of the anode segments and the columns of the grid electrodes are disposed in a matrix form such that each of the grid electrodes faces M/2 anode segments in each of the rows of the anode segments, wherein the driving circuit turns on, in one frame, a plurality of selected pixels one by one to sequentially emit lights in accordance with a display signal, each selected pixel being formed of M/2 anode segments selected from a group of M anode segments to be turned on to emit lights by turning on a first and a second grid electrode positioned adjacent to each other, wherein the M/2 anode segments of each selected pixel are sequentially disposed and include at least $(M/4-2^{(k-3)})$ anode segments facing the first grid electrode and at least $(M/4-2^{(k-3)})$ anode segments facing the second grid electrode, and wherein, in multiple frames, R varies among integers from $(M/4-2^{(k-3)})$ to $(M/4+2^{(k-3)})$, R being the number of said at least $(M/4-2^{(k-3)})$ anode segments facing the first grid electrode.

11. The driving circuit of claim 10, wherein R varies frame-by-frame and R's of $(2^{(k-2)}+1)$ sequential frames are different from each other.

12. A method of driving an M-tuple anode matrix vacuum fluorescent display (VFD) which includes a plurality of rows of anode segments wherein each row of anode segments is divided into groups, each group having M anode segments and M anode inlet lines formed by laterally connecting anode segments located at same relative positions in the groups, M being an integer that is represented by $2^K$ and K being an integer that is 3 or greater; and a plurality of columns of grid electrodes extending in a longitude direction perpendicular to the rows of the anode segments, each having a grid inlet line, wherein the rows of the anode segments and the columns of the grid electrodes are disposed in a matrix form such that each of the grid electrodes faces M/2 anode segments in each of the rows of the anode segments, the method comprising:

turning on, in one frame, a plurality of selected pixels one by one to sequentially emit lights in accordance with a display signal, each selected pixel being formed of M/2 anode segments selected from a group of M anode segments to be turned on to emit lights by turning on a first and a second grid electrode positioned adjacent to each other, wherein the M/2 anode segments of each selected pixel are sequentially disposed and include at least $(M/4-2^{(k-3)})$ anode segments facing the first grid electrode and at least $(M/4-2^{(k-3)})$ anode segments facing the second grid electrode, and wherein, in multiple frames, R varies among integers from $(M/4-2^{(k-3)})$ to $(M/4+2^{(k-3)})$, R being the number of said at least $(M/4-2^{(k-3)})$ anode segments facing the first grid electrode.

13. The method of claim 12, wherein R varies frame-by-frame and R's of $(2^{(k-2)}+1)$ sequential frames are different from each other.

* * * * *